United States Patent [19]

Jones et al.

[11] Patent Number: 4,478,929

[45] Date of Patent: Oct. 23, 1984

[54] DYE IMAGE TRANSFER FILM UNIT WITH TABULAR SILVER HALIDE

[75] Inventors: Cynthia G. Jones, Bergen; Cliff O. Hill, Webster, both of N.Y.

[73] Assignee: Eastman Kodak Company, Rochester, N.Y.

[21] Appl. No.: 553,911

[22] Filed: Nov. 21, 1983

Related U.S. Application Data

[63] Continuation-in-part of Ser. No. 430,092, Sep. 30, 1982, abandoned, which is a continuation-in-part of Ser. No. 320,911, Nov. 12, 1981, abandoned.

[51] Int. Cl.[3] ..... G03C 5/54; G03C 1/40

[52] U.S. Cl. ..... 430/217; 430/567

[58] Field of Search ..... 430/217, 567, 569

[56] References Cited

U.S. PATENT DOCUMENTS

| | | | |
|---|---|---|---|
| 3,894,871 | 7/1975 | Land | 430/228 |
| 4,063,951 | 12/1977 | Bogg | 430/567 |
| 4,067,739 | 1/1978 | Lewis | 430/567 |
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |
| 4,386,156 | 5/1983 | Mignot | 430/567 |
| 4,399,215 | 8/1983 | Wey | 430/569 |
| 4,411,986 | 10/1983 | Abbott et al. | 430/569 |
| 4,414,304 | 11/1983 | Dickerson | 430/567 |
| 4,414,310 | 11/1983 | Davbendiek et al. | 430/567 |
| 4,433,048 | 2/1984 | Solberg et al. | 430/569 |
| 4,434,226 | 2/1984 | Wilgus et al. | 430/569 |
| 4,439,520 | 3/1984 | Kofron et al. | 430/569 |

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 1570581 | 7/1980 | United Kingdom . |

OTHER PUBLICATIONS

Zelikman and Levi, *Making and Coating Photographic Emulsions,* Focal Press, 1964, p. 223.

deCugnac and Chateau, "Evolution of the Morphology of Silver Bromide Crystals During Physical Ripening", *Science et Industries Photographiques,* vol. 33, No. 2, (1962), pp. 121–125.

Duffin, *Photographic Emulsion Chemistry,* Focal Press, 1966, pp. 66–72.

Trivelli and Smith, "The Effect of Silver Iodide Upon the Structure of Bromo-Iodide Precipitation Series", *The Photographic Journal,* vol. LXXX, Jul. 1940, pp. 285–288.

Gutoff, "Nucleation and Growth Rates During the Precipitation of Silver Halide Photographic Emulsions", *Photographic Sciences and Engineering,* vol. 14, No. 4, Jul.–Aug. 1970, pp. 248–257.

*Primary Examiner*—Richard L. Schilling

*Attorney, Agent, or Firm*—Carl O. Thomas

[57] ABSTRACT

Photographic dye image transfer film units are disclosed employing negative working high aspect ratio tabular grain silver halide emulsions. The dye image transfer film units can achieve a variety of advantages, such as reductions in silver coverage with diminished reductions in speed, diminished increases in minimum density levels, allowing a transferred image to be rapidly accessible for viewing, and producing lower minimum densities and higher maximum densities for a given time of development, and greater image discrimination. Improvements in other photographic characteristics (such as sharpness), advantageous layer order arrangements, and reduction or elimination of various layers, such as yellow filter layers and scavenger interlayers can be obtained also.

42 Claims, 1 Drawing Figure

DYE IMAGE TRANSFER FILM UNIT WITH TABULAR SILVER HALIDE

FIELD OF THE INVENTION

This invention relates to novel photographic film units. More specifically, this invention relates to photographic dye image transfer film units which employ at least one negative working radiation sensitive silver halide emulsion layer.

BACKGROUND OF THE INVENTION

The most commonly employed dye image—i.e., color—photographic elements are those containing one or more negative working radiation sensitive silver halide emulsion layers. Their widespread use is attributable to the excellent quality dye images they are capable of producing and to their high speed, allowing them to be employed in hand-held cameras under a variety of lighting conditions.

Nevertheless, negative working silver halide color photographic elements exhibit a significant limitation in terms of viewing the photographic image. Imagewise exposure of the negative working silver halide emulsion layer does not produce an immediately viewable dye image. Exposure produces an invisible latent image in the silver halide emulsion. Additional steps are required to produce a viewable dye image. Historically this has meant removing the photographic element from the camera, processing in aqueous solutions, and obtaining a first dye image. The first dye image obtained is a negative image, and a second exposure through the negative dye image of an additional photographic element and processing thereof is required to produce a viewable positive dye image of the subject initially photographed. (It is also possible with element or process modifications to produce a positive dye image directly in the photographic element which is imagewise exposed.)

Image transfer photography has made it possible to reduce the delay between imagewise exposure and obtaining a viewable dye image. Immediately after imagewise exposing the negative working radiation sensitive silver halide emulsion layer or layers, a processing solution can be brought into contact therewith. As silver halide development occurs, a transferred dye image can be formed in a receiving layer for viewing. In this way, visual access to the photographic image can occur in minutes or even seconds.

Still, though measured in seconds, the delay in providing visual access remains an important limitation in silver halide image transfer photography. Subject opportunities can be fleeting, and the photographer needs as nearly an instantaneous visual verification of an acceptable photographic image as can be offered.

Although image transfer has reduced the time required for image access in silver halide photography, this advantage has not been achieved without other sacrifices. One significant long term concern of image transfer photography relates to consumption of silver. Multicolor silver halide photographic elements which are conventionally processed and dye image transfer film units both employ relatively high silver coverages to obtain maximum photographic speed. Typically about 1000 milligrams of silver per square meter is required to form each of the blue, green, and red exposure records. In conventionally processed multicolor photographic elements the image produced contains no silver and all of the silver present in the photographic element is, in theory, recoverable. On the other hand, in image transfer photography silver is seldom recovered, and in integral format image transfer film units all of the silver remains with the photographic film units forming the viewable image.

Another disadvantage, inherent in dye image transfer photography, is the reduction in image sharpness attributable to dye diffusion. As image dye diffuses from the silver halide emulsion layer or an adjacent dye releasing layer, diffusion occurs both in the direction of the receiving layer and laterally, leading to image spreading and loss of sharpness. Sharpness can be improved by decreasing the length of the diffusion path to the receiving layer. This is controlled by the number and thickness of the layers to be traversed. Unfortunately, the minimum thickness of the silver halide emulsion layers is limited by the size of the silver halide grains and the weight ratio of gelatin to silver halide. Further, in multicolor image transfer film units employing three superimposed dye providing layer units, intervening dye providing layer units and separating interlayers must be penetrated by diffusing dyes migrating to the receiving layer.

Another consideration that arises in dye image transfer photography is image density variance as a function of temperature differences. Since subject opportunities are presented under a variety of temperature conditions and since the primary advantage of image transfer photography is ready image access, it follows that the ability of dye image transfer film units to produce acceptable dye images at a variety of temperatures is also important. Image transfer photography is much different than conventional photography in this respect, since in the latter processing is rarely undertaken without control of temperature.

In considering the characteristics of dye image transfer film units employing negative working silver halide emulsions, whether the dye image providing material is initially mobile or immobile is of importance as well as whether the dye image providing material is positive working or negative working. In general positive working dye image providing materials are most commonly employed with negative working silver halide emulsions, since, in the absence of uncommon reversal techniques, this results in a viewable positive transferred dye image. Although typically more complex in their imaging mechanisms, initially immobile positive working dye image providing materials are generally preferred over initially mobile positive working dye image providing materials, since image dye transfer can be more easily controlled. For specialized applications, such as when a negative transferred dye image is required or the subject being photographed is itself a negative image, negative working dye image providing materials of the type commonly employed in combination with direct positive silver halide emulsions to produce positive transferred dye images can be employed in combination with negative working silver halide emulsions. Turning to negative working dye image providing materials, the initially immobile dye image providing materials that have been developed for use with direct positive silver halide emulsions tend to yield high minimum densities and low image discrimination when employed in combination with camera speed negative working silver halide emulsions.

Silver halide image transfer film units are generally well known in the art of photography and require no detailed description. Broad discussions of image transfer elements and processes (including process solutions) can be found in Chapter 12, "One Step Photography", *Neblette's Handbook of Photography and Reprography Materials, Processes and Systems,* 7th Ed. (1977), in Chapter 16, "Diffusion Transfer and Monobaths", T. H. James, *The Theory of the Photographic Process,* 4th Ed. (1977), and A. Rott and E. Weyde, *Photographic Silver Halide Diffusion Processes,* Focal Press, (1972). Patents relating to silver halide image transfer are collected in U.S. Patent and Trademark Office Class 430 RADIATION IMAGERY CHEMISTRY—PROCESS, COMPOSITION OR PRODUCT, subclasses 199 through 255.

A great variety of regular and irregular grain shapes have been observed in silver halide photographic emulsions intended for imaging applictions. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, page 223. Rods and tabular grains in varied portions have been frequently observed mixed in among other grain shapes, particularly where the pAg (the negative logarithm of silver ion concentration) of the emulsions has been varied during precipitation, as occurs, for example in single-jet precipitations.

Tabular grains (those areally extended in two dimensions as compared to their thickness) have been extensively studied, often in macro-sizes having no photographic utility. Tabular grains are herein defined as those having two substantially parallel crystal faces, each of which is substantially larger than any other single crystal face of the grain. A discussion of tabular bromoiodide grains appears in Duffin, *Photographic Emulsion Chemistry,* Focal Press, 1966, pp. 66–72, and Trivelli and Smith, "The Effect of Silver Iodide Upon the Structure of Silver Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Tabular silver bromide emulsions are discussed by de Cugnac and Chateau, "Evolution of the Morphology of Silver Bromide Crystals During Physical Ripening", *Science et Industries Photographiques,* Vol. 33, No. 2 (1962), pp. 121–125. Sulfur sensitized tabular grain silver bromide emulsions having an average aspect ratio of from about 5 to 7:1 wherein the tabular grains account for greater than 50% of the projected area of the total grain population were incorporated in a direct X-ray radiographic product, No Screen X-Ray Code 5133, sold by Eastman Kodak Company from 1937 until the 1950's. Gutoff, "Nucleation and Growth Rates During the Precipitation of Silver Halide Photographic Emulsions", *Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published specific procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 teaches the preparation of silver halide emulsions wherein most of the crystals are of the twinned octahedral type by forming seed crystals, by Ostwald ripening in the presence of a silver halide solvent, and completing grain growth without renucleation or Ostwald ripening while controlling pBr (the negative logarithm of bromide ion concentration). Maternaghan U.S. Pat. Nos. 4,150,994 and 4,184,877, U.K. Pat. No. 1,570,581, and German OLS publications Nos. 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed; e.g., a grain consisting of silver bromoiodide containing 40 mole percent iodide also contains 60 mole percent bromide.) Lewis and Maternaghan report increased covering power. Maternaghan states that the emulsions are useful in camera films, both black-and-white and color. Bogg specifically reports an upper limit on aspect ratios of 7:1, and, from the very low aspect ratios obtained by the examples, the 7:1 aspect ratio appears unrealistically high. It appears from repeating examples and viewing the photomicrographs published that the aspect ratios realized by Lewis and Maternaghan were also less than 7:1.

Class 430, cited above, subclass 217 (Silver halide identified grain, identified emulsion binder other than nominal gelatin, or identified sensitizer or identified desensitizer containing) contains a collection of patents directed to silver halide image transfer photography, many of which disclose specific silver halide grain structures.

Wilgus and Haefner discloses high aspect ratio silver bromoiodide emulsions and a process for their preparation. U.S. Pat. No. 4,439,520 discloses chemically and spectrally sensitized high aspect ratio tabular grain silver halide emulsions and photographic elements incorporating these emulsions.

Daubendiek and Strong U.S. Pat. No. 4,414,310 discloses an improvement on the processes of Maternaghan whereby high aspect ratio tabular grain silver bromoiodide emulsions can be prepared.

Abbott and Jones U.S. Pat. No. 4,425,425 discloses the use of high aspet ratio tabular grain silver halide emulsions in radiographic elements coated on both major surfaces of a radiation transmitting support to control crossover.

Wey, U.S. Pat. No. 4,399,215 discloses a process of preparing tabular silver chloride grains which are substantially internally free of both silver bromide and silver iodide. The emulsions have an average aspect ratio of greater than 8:1.

Solberg, Piggin, and Wilgus U.S. Pat. No. 4,433,048 discloses high aspect ratio tabular grain silver bromoiodide emulsions wherein a higher concentration of iodide is present in an annular region than in a central region of the tabular grains.

Dickerson U.S. Pat. No. 4,414,304 discloses producing silver images of high covering power by employing photographic elements containing forehardened high aspect ratio tabular grain silver halide emulsions.

Mignot U.S. Pat. No. 4,386,156 discloses high aspect ratio tabular grain silver bromide emulsions wherein the tabular grains are square or rectangular in projected area.

SUMMARY OF THE INVENTION

In one aspect this invention is directed to a photographic image transfer film unit comprising a support, a negative working emulsion layer on the support containing a dispersing medium and radiation sensitive silver halide grains, located in the emulsion layer or in a layer adjacent thereto a positive working dye image providing material capable of providing transferred image dye in the absence of silver halide development, and a receiving layer for providing a viewable transferred dye image following imagewise exposure and processing of the emulsion layer. The photographic film unit is characterized by at least 50 percent of the total projected area of the radiation sensitive silver halide grains being provided by tabular silver halide grains having a thickness of less than 0.5 micron, a diameter of at least 0.6 micron, and an average aspect ratio of greater than 8:1.

In another aspect this invention is directed to a photographic image transfer film unit comprising a support, a negative working emulsion layer on the support containing a dispersing medium and radiation sensitive silver halide grains, located in the emulsion layer or in a layer adjacent thereto an initially immobile negative working dye image providing material capable of providing transferred image dye in response to silver halide development, and a receiving layer for providing a viewable transferred dye image following imagewise exposure and processing of the emulsion layer. The photographic film unit is characterized by at least 50 percent of the total projected area of the radiation sensitive silver halide grains being provided by tabular silver halide grains having a thickness of less than 0.5 microns, a diameter of at least 0.6 micron, and an average aspect ratio of greater than 8:1.

It is a demonstrated advantage of the present invention that the dye image transfer film units containing positive working dye image providing materials permit reduction in silver coverages. More specifically, it has been demonstrated that such dye image transfer film units according to this invention exhibit less reduction in speed as a function of reduced silver coverage when initially immobile dye image providing materials, such as positive working dye releasers, are employed, and it has been demonstrated that such dye image transfer film units according to this invention exhibit less increase in minimum dye density as a function of reduced silver coverage when initially mobile dye image providing materials, such as dye or dye precursor developers, are employed. While Applicants do not wish to be bound by any particular theory to account for these improvements, it is believed that these unexpected advantages result from the more rapid onset of development of high aspect ratio tabular grain emulsions.

It is has been demonstrated that the photographic dye image transfer film units of this invention containing initially immobile negative working dye image providing materials are capable of producing transferred images with less time elapsed after the commencement of processing—i.e., with reduced access time. These image transfer film units have been further demonstrated to produce lower minimum densities, higher maximum densities for a given time of development, and greater image discrimination (maximum density minus minimum density). Still other photographic advantages are realized with various specific forms of the dye image transfer film units described below.

Kofron et al, cited above, discloses significant advantages in speed granularity relationship, sharpness, and blue and minus blue sensitivity differences for chemically and spectrally sensitized high aspect ratio tabular grain emulsions. The high aspect ratio tabular grain emulsions enhance sharpness of underlying emulsion layers when they are positioned to receive light that is free of significant scattering. These emulsions are particularly effective in this respect when they are located in the emulsion layers nearest the source of exposing radiation. When spectrally sensitized outside the blue portion of the spectrum, the high aspect ratio tabular grain silver bromide and bromoiodide emulsions exhibit a large separation in their sensitivity in the blue region of the spectrum as compared to the region of the spectrum to which they are spectrally sensitized. Minus blue sensitized high aspect ratio tabular grain silver bromide and bromoiodide emulsions are much less sensitive to blue light than to minus blue light and do not require filter protection to provide acceptable minus blue exposure records when exposed in neutral light, such as daylight at 5500° K. The high aspect ratio tabular grain emulsions exhibit improved speed granularity relationships as compared to previously known tabular grain emulsions and as compared to the best speed granularity relationships heretofore achieved with emulsions of the same halide content generally. Very large increases in blue speed of high aspect ratio tabular grain silver bromide and bromoiodide emulsions have been realized as compared to their native blue speed when blue spectral sensitizers are employed.

DESCRIPTION OF THE DRAWING

The invention can be better appreciated by reference to the following detailed description considered in conjunction with the drawing, in which.

DESCRIPTION OF PREFERRED EMBODIMENTS

Figure 1:
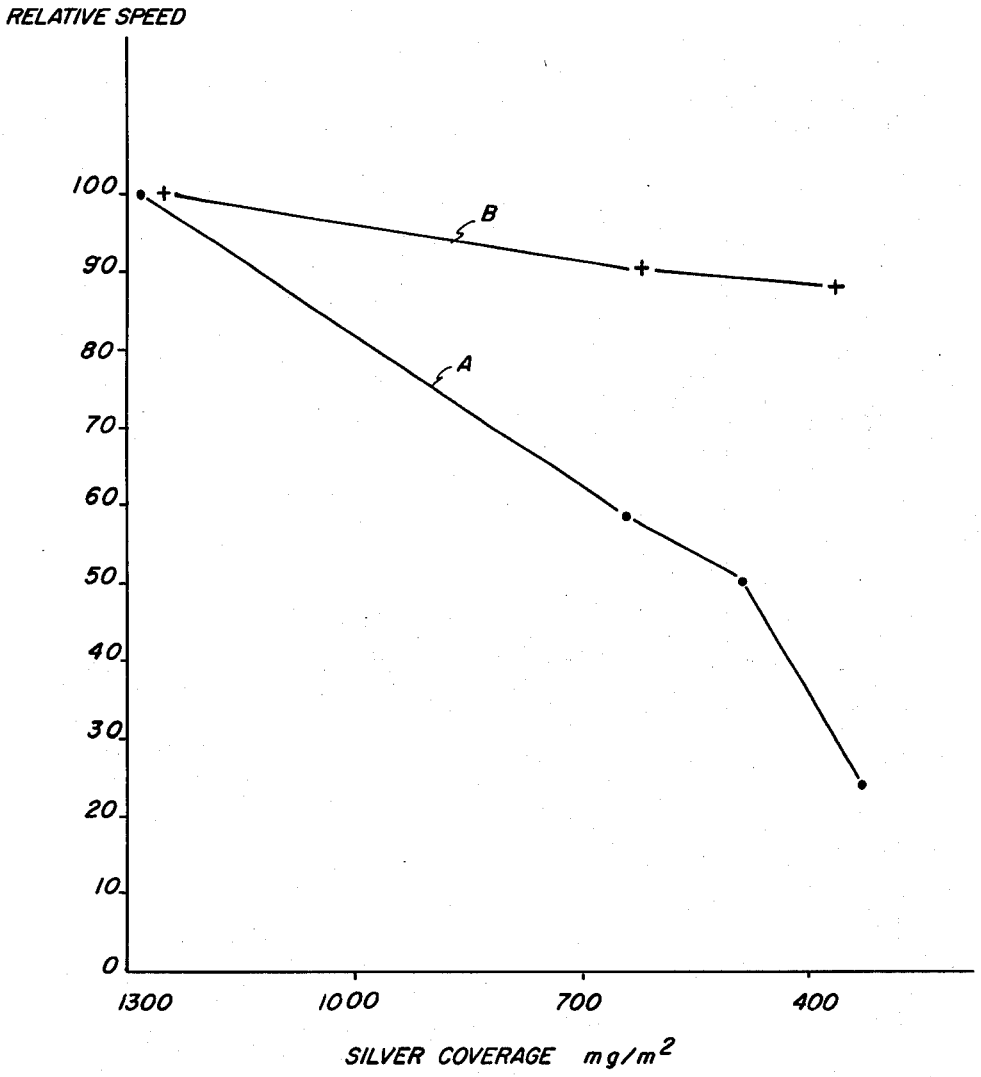
FIG. 1 is a plot of silver coverage versus relative speed, where A is a control and B represents the invention.

The present invention is broadly directed to photographic image transfer film units comprised of a conventional photographic support, one or more silver halide emulsion layers located on the support, and a receiving layer for providing a viewable transferred image following imagewise exposure and processing of the silver halide emulsion layer or layers.

SILVER HALIDE EMULSIONS

To obtain the advantages of the invention at least one emulsion layer of the image transfer film unit is a high aspect ratio tabular grain silver halide emulsion. As applied to the silver halide emulsions of the present invention the term "high aspect ratio" is herein defined as requiring that the silver halide grains having a thickness of less than 0.5 micron, preferably less than 0.3 micron, and a diameter of at least 0.6 micron have an average aspect ratio of greater than 8:1 and account for at least 50 percent of the total projected area of the silver halide grains.

The preferred high aspect ratio tabular grain silver halide emulsions present in the image transfer film units of the present invention are those wherein the silver halide grains having a thickness of less than 0.5 micron (preferably less than 0.3 micron and optimally less than 0.2 micron) and a diameter of at least 0.6 micron have an average aspect ratio of at least 12:1 and optimally at least 20:1. These silver halide grains have an average diameter less than 30 microns (preferably less than 15 microns and optimally less than 10 microns). In a preferred form of the invention these silver halide grains account for at least 70 percent and optimally at least 90 percent of the total projected area of the silver halide grains. It is appreciated that the thinner the tabular grains accounting for a given percentage of the projected area, the higher the average aspect ratio of the emulsion. Typically the tabular grains have an average thickness of at least 0.03 micron, although even thinner tabular grains can in principle be employed—e.g., as low as 0.01 micron, depending on halide content.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each tabular grain and to identify those tabular grains having a thickness of less than 0.5 micron (or 0.3 micron) and a diameter of at least 0.6 micron. From this the aspect ratio of each such tabular grain can be calculated, and the aspect ratios of all the tabular grains in the sample meeting the thickness and diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.5 or 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the tabular grains meeting the thickness and diameter critera can be calculated.

In the above determinations a reference tabular grain thickness of less than 0.5, preferably 0.3, micron was chosen to distinguish the uniquely thin tabular grains herein contemplated from thicker tabular grains which provide inferior emulsion properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory,* Morgan and Morgan, New York, p. 15.

The tabular grains can be of any silver halide crystal composition known to be useful in photography. In a preferred form offering a broad range of observed advantages the present invention employs high aspect ratio silver bromoiodide emulsions. High aspect ratio silver bromoiodide emulsions and their preparation is the subject of Wilgus and Haefner, cited above and here incorporated by reference.

High aspect ratio tabular grain silver bromoiodide emulsions can be prepared by a precipitation process which forms a part of the Wilgus and Haefner invention. Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight, of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is preferred to maintain the pBr of the reaction vessel at or above 1.1. (As herein employed, pBr is defined as the negative logarithm of bromide ion concentration. Both pH and pAg are similarly defined for hydrogen and silver ion concentrations, respectively.)

During precipitation silver, bromide, and iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei is formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.6. It is, of course, possible and, in fact, preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide are precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 mols per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application No. 80102242, and Wey "Growth Mechanism of AgBr Crystals in Gelatin Solution", *Photographic Science and Engineering*, Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

The concentration of iodide in the silver bromoiodide emulsions of the image transfer film units of this invention can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 mole percent, with optimum iodide concentrations being up to about 15 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al, cited above, has recognized that advantages in photographic speed and/or grain result from increasing the proportion of iodide in annular regions of high aspect ratio tabular grain silver bromoiodide emulsions as compared to central regions of the tabular grains. Solberg et al teaches iodide concentrations in the central regions of the tabular grains of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. Solberg et al constitutes a preferred species of the present invention and is here incorporated by reference. In a variant form it is specifically contemplated to terminate iodide or bromide and iodide salt addition to the reaction vessel prior to the termination of silver salt addition so that excess bromide reacts with the silver salt. This results in a shell of silver bromide being formed on the tabular silver bromoiodide grains. Thus, it is apparent that the tabular silver bromoiodide grains of the image transfer film units of the present invention can exhibit substantially uniform or graded iodide concentration profiles and that the gradation can be controlled, as desired, to favor higher iodide concentrations internally or at or near the surfaces of the tabular silver bromoiodide grains.

Although the preparation of the high aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that Wilgus and Haefner is described by Daubendiek and Strong, cited above and here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron.

High aspect ratio tabular grain silver bromide emulsions lacking iodide can be prepared by the process described by Wilgus and Haefner modified to exclude iodide. High aspect ratio tabular grain silver bromide emulsions can alternatively be prepared following a procedure similar to that employed by Cugnac and Chateau, cited above and here incorporated by reference. High aspect ratio silver bromide emulsions containing square and rectangular grains can be prepared as taught by Mignot U.S. Pat. No. 4,386,156, cited above and here incorporated by reference. In this process cubic seed grain having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having an average aspect ratio of at least 8.5:1. Still other preparations of high aspect ratio tabular grain silver bromide emulsions lacking iodide are illustrated in the examples.

To illustrate other high aspect ratio tabular grain silver halide emulsions which can be employed in the practice of this invention, attention is directed to Wey, cited above and here incorporated by reference, which discloses a process of preparing tabular silver chloride grains which are substantially internally free of both silver bromide and silver iodide. Wey employs a double-jet precipitation process wherein chloride and silver salts are concurrently introduced into a reaction vessel containing dispersing medium in the presence of ammonia. During chloride salt introduction the pAg within the dispersing medium is in the range of from 6.5 to 10 and the pH in the range of from 8 to 10. The presence of ammonia and high temperatures tends to cause thick grains to form, therefore precipitation temperatures are limited to up to 60° C. The process can be optimized to produce high aspect ratio tabular grain silver chloride emulsions.

Maskasky U.S. Pat. No. 4,400,463, here incorporated by reference, discloses a process of preparing tabular grains of at least 50 mole percent chloride having opposed crystal faces lying in {111} crystal planes and, in one preferred form, at least one peripheral edge lying parallel to a <211> crystallographic vector in the plane of one of the major surfaces. Such tabular grain emulsions can be prepared by reacting aqueous silver and chloride containing halide salt solutions in the presence of a crystal habit modifying amount of an aminoazaindene and a peptizer having a thioether linkage.

Wey and Wilgus U.S. Pat. No. 4,414,306, here incorporated by reference, discloses tabular grain emulsions wherein the silver halide grains contain chloride and bromide in at least annular grain regions and preferably throughout. The tabular grain regions containing silver chloride and bromide are formed by maintaining a molar ratio of chloride and bromide ions of from 1.6 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromide and/or iodide, can be prepared as taught by Maskasky, cited above. The maximum average grain diameters of the high aspect ratio tabular grain emulsions are in all instances less than 30 microns, preferably less than 15 microns, and optimally no greater than 10 microns.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975, Item 13452. *Research Disclosure* is a publication of Kenneth Mason Publications Limited; Emsworth; Hampshire P010 7DD; United Kingdom. The tabular grain emulsions can be internally reduction sensitized during precipitation, as illustrated by Moisar et al, *Journal of Photographic Science,* Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304, and Claes et al, *Photographische Korrespondenz,* Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. Patent Application No. 2,022,431A, Saito et al German OLS Nos. 2,555,364 and 2,556,885, and *Research Disclosure,* Volume 166, February 1978, Item 16662.

In forming the tabular grain emulsions peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali treated gelatin (cattle bone or hide gelatin) or acid treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and 2,614,929, Lowe et al U.S. Pat. Nos. 2,691,582, 2,614,930, 2,614,931, 2,327,808, and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461, and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312, and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116, and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, 2,276,323, 2,281,703, 2,311,058, and 2,414,207, Lowe et al U.S. Pat. Nos. 2,484,456, 2,414,474, and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918, and 3,925,083, Fitzgerald et al U.S. Pat. No. 3,879,205, Nottorf U.S. Pat. No. 3,142,568, Houck et al U.S. Pat. Nos.

3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and 808,228, Wood U.K. Pat. No. 822,192, and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions of this invention exhibiting the highest realized speed granularity relationships. The preferred emulsions for use in the present invention are non-ammoniacal or neutral emulsions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The high aspect ratio tabular grain emulsions are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409, and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287, and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce high aspect ratio tabular grain emulsions in which the tabular grains satisfying the thickness and diameter criteria for aspect ratio account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

In accordance with established practices within the art it is specifically contemplated to blend the high aspect ratio tabular grain emulsions with each other or with conventional emulsions to satisfy specific emulsion requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape between its toe and shoulder. Conventional silver halide emulsions suitable for use in blending are illustrated by *Research Disclosure,* Vol. 176, December 1978, Item 17643, Paragraph I.

The high aspect ratio tabular grain silver halide emulsions employed in the present invention are preferably chemically sensitized. Preferred chemical sensitization of high aspect ratio tabular grain silver halide emulsions is taught by Kofron et al, cited above and here incorporated by reference. They can be chemically sensitized with active gelatin, as illustrated by T. H. James, *The Theory of the Photographic Process,* 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415, and Simons U.K. Pat. No. 1,396,696; chemical sensitization being optionally conducted in the presence of thiocyanate compounds in concentrations of up to 2 mole percent, based on silver, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin *Photographic Emulsion Chemistry,* Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,739,060, Roberts et al U.S. Pat. Nos. 2,743,182 and 2,743,183, Chambers et al U.S. Pat. No. 3,026,203, and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

Although the high aspect ratio tabular grain silver halide emulsions are generally responsive to the techniques for chemical sensitization known in the art in a qualitative sense, in a quantitative sense—that is, in terms of the actual speed increases realized—the tabular grain emulsions require careful investigation to identify the optimum chemical sensitization for each individual emulsion, certain preferred embodiments being more specifically discussed below.

The high aspect ratio tabular grain silver halide emulsions can be spectrally sensitized. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The high aspect ratio tabular grain silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering*, Vol. 18, 1974, pp. 49–53 (Sturmer et al), pp. 175–178 (Leubner) and pp. 475–485 (Gilman). Oxidation and reduction potentials can be measured as described by R. F. Large in *Photographic Sensitivity*, Academic Press, 1973, Chapter 15.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964. Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes. Even when the emulsions of the invention are high aspect ratio tabular grain silver bromide and silver bromoiodide emulsions, very large increases in speed are realized by the use of blue spectral sensitizing dyes. Where it is intended to expose emulsions according to the present invention in their region of native sensitivity, advantages in sensitivity can be gained by increasing the thickness of the tabular grains.

Useful blue spectral sensitizing dyes for high aspect ratio tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics.

Among useful spectral sensitizing dyes for sensitizing silver halide emulsions are those found in U.K. Pat. No. 742,112, Brooker U.S. Pat. Nos. 1,846,300, 1,846,301, 1,846,302, 1,846,303, 1,846,304, 2,078,233, and 2,089,729, Brooker et al U.S. Pat. Nos. 2,165,338, 2,213,238, 2,231,658, 2,493,747, 2,493,748, 2,526,632, 2,739,964 (U.S. Pat. No. 24,292), 2,778,823, 2,917,516, 3,352,857, 3,411,916, and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470, and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and nonlight absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular silver halide grains. To realize the full advantages of this invention it is preferred to adsorb spectral sensitizing dye to the tabular grain surfaces in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol 56, p. 1065, 1952; Spence et al, "Desensitization of Sensitizing Dyes", *Journal of Physical and Colloid Chemistry*, Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process*, 1942, Macmillan, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrent with chemical sensitization, can entirely precede chemical sensitization, and can even commence prior to the completion of silver halide grain precipitation, as taught by Philippaerts et al U.S. Pat. No. 3,628,960 and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

In one preferred form, spectral sensitizers can be incorporated in the emulsions of the present invention prior to chemical sensitization. Useful results have also been achieved by introducing other adsorbable materials, such as finish modifiers, into the emulsions prior to chemical sensitization. For example, an ultraviolet adsorber, blue spectral sensitizing dye, or other finish modifier can be introduced into an emulsion prior to chemical sensitization along with a minus blue (i.e., green or red) along with spectral sensitizing dye. In this way the concentration of the minus blue spectral sensitizing dye can be held to just that level preferred for spectral sensitization.

It has been discovered quite unexpectedly by Kofron et al, cited above, that high aspect ratio tabular grain silver halide emulsions can exhibit higher speed granularity relationships when chemically and spectrally sensitized than have been heretofore realized using tabular grain silver halide emulsions and have been heretofore realized using silver halide emulsions of the highest known speed granularity relationships. Best results have been achieved using minus blue (red and/or green) spectral sensitizing dyes.

In one preferred form, spectral sensitizers can be incorporated in the emulsions of the present invention prior to chemical sensitization. Useful results have also been achieved by introducing other adsorbable materials, such as finish modifiers, into the emulsions prior to chemical sensitization. For example, an ultraviolet absorber, blue spectral sensitizing dye, or other finish modifier can be introduced into an emulsion along with a minus blue (i.e., green or red) spectral sensitizing dye prior to chemical sensitization. In this way the concentration of the minus blue spectral sensitizing dye can be held to just that level preferred for spectral sensitization.

In another approach, which can be practiced in combination with the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky U.S. Pat. No. 4,435,501 both of which are here incorporated by reference, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed granularity relationships are gold and sulfur sensitizers, gold and selenium sensitizers, and gold, sulfur, and selenium sensitizers. Thus, in a preferred form of the invention, the high aspect ratio tabular grain silver bromoiodide emulsions employed contain a middle chalcogen, such as sulfur and/or selenium, which may not be detectable, and gold, which is detectable. The emulsions can also contain detectable levels of thiocyanate, although the concentration of the thiocyanate in the final emulsions can be greatly reduced by known emulsion washing techniques. In various of the preferred forms indicated above the tabular silver bromoiodide grains can have another silver salt at their surface, such as silver thiocyanate, silver chloride, or silver bromide, although the other silver salt may be present below detectable levels.

Although not required to realize all of their advantages, the emulsions are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the silver halide grains of an emulsion have been characterized, it is possible to estimate from further product analysis and performance evaluation whether an emulsion layer of a product appears to be substantially optimally chemically and spectrally sensitized in relation to comparable commercial offerings of other manufacturers.

DYE IMAGE TRANSFER

The photographic image transfer film units of the invention can provide a transferred dye image. Except as noted, the features of dye image transfer film units can be identical to those of the silver image transfer film units discussed above and are not redescribed in detail.

In perhaps the simplest application of the invention, a high aspect ratio tabular grain silver halide emulsion as described above is substituted for the silver halide emulsion layer in a conventional dye image transfer photographic film unit. In addition to a conventional photographic support on which the tabular silver halide emulsion layer is located, the dye image transfer film unit preferably includes a dye receiving layer comprised of a mordant. To produce a transferred dye image the dye receiving and emulsion layers are juxtaposed, and a conventional processing solution containing a silver halide developing agent is released to contact the emulsion and receiving layers after imagewise exposure of the tabular grain emulsion layer.

In dye image transfer film units the emulsion and receiving layers can be related in any convenient conventional manner. The emulsion layer or layers and the receiving layer can be located on the same support or different supports. When the receiving layer is coated on a separate support, the layer and the support, together with any additional layers present, are collectively termed a receiver. In a common preferred peel-apart format the emulsion layer bearing support is opaque and the receiver support is reflective (e.g., white) or is provided with a reflective layer beneath the receiving layer. Exposure occurs before juxtaposing the receiver and emulsion layer for processing. In a common integral format both the receiver support and the emulsion layer support are transparent and a reflective (e.g., white) background for viewing the silver image is provided by overcoating the receiving layer with a reflective pigment layer or incorporating the pigment in the processing solution. A preferred receiver also commonly includes a neutralizing layer (also referred to as a pH lowering or acid layer) for terminating development and at least one timing layer (also sometimes referred to as a spacer or "inert" spacer layer.) Neutralizing and timing layers can alternatively be located on the emulsion bearing support. The receiver and emulsion bearing supports are preferably integral—that is, joined during exposure, processing, and viewing, but in various formats they can be separate during exposure, viewing, and/or a portion of processing. Exemplary materials for use in the neutralizing and timing layers are described in *Research Disclosure,* Vol. 123, July 1974, Item 13331, and Vol. 135, Item 13525, July 1975. Details of reflective layers and support materials, including incorporated ultraviolet absorbers and optical brighteners, are disclosed in *Research Disclosure,* Vol. 151, November 1976, Item 15162. Specifically preferred transparent support materials are poly(ethylene terephthalate) and cellulose esters. Preferred reflective supports are resin coated paper supports.

In a preferred embodiment, the film units of this invention contain an alkaline processing composition and means for its containment and discharge within the film unit. A preferred means is a rupturable container (e.g., pod) which is adapted to be positioned during processing of the film unit so that a compressive force applied to the container by pressure applying members, such as found in a camera designed for in-camera processing, will effect a discharge of the container's contents within the film unit. However, other methods of introducing the alkaline processing composition can be employed. Processing alternatives are further illustrated by *Research Disclosure,* Item 17643, cited above, Paragraphs XXIII, C and G, here incorporated by reference.

It is possible to construct a dye image transfer film unit according to the present invention capable of producing a monochromatic transferred dye image by locating on a support a single dye providing layer unit comprised of a tabular silver halide emulsion layer as described above and at least one dye image providing material in the emulsion layer itself or in an adjacent layer of the layer unit. In addition, the dye image transfer film unit is comprised of a dye receiving layer capable of mordanting or otherwise immobilizing dye migrating to it. To produce a transferred dye image the tabular emulsion layer is imagewise exposed and an alkaline processing solution is brought into contact with the emulsion layer with the dye receiving and emulsion layers juxtaposed. In a particularly advantageous application for monochromatic transferred dye images a combination of dye image providing materials is employed to provide a neutral transferred dye image. This image can be used to supplement the transferred silver image or to replace it entirely in providing a viewable black-and-white image. Of course, monochromatic transferred dye images of any hue can be produced, if desired.

Multicolor dye image transfer film units of this invention employ three dye providing layer units: (1) a cyan dye providing layer unit comprised of a red sensitive silver halide emulsion having associated therewith a cyan dye image providing material, (2) a magenta dye providing layer unit comprised of a green sensitive silver halide emulsion having associated therewith a magenta dye image providing material, and (3) a yellow dye providing layer unit comprised of a blue sensitive silver halide emulsion having associated therewith a yellow dye image providing material. Each of the dye providing layer units can contain one, two, three, or more separate silver halide emulsion layers as well as the dye image providing material, located in the emulsion layers or in one or more separate layers forming part of the dye providing layer unit. Any one or combination of the emulsion layers can be high aspect ratio tabular grain silver halide emulsion layers as described above. In a preferred form of the invention at least the fastest emulsion layers in the cyan and magenta dye providing layer units are high aspect ratio tabular grain silver halide emulsions as described above. At least the fastest emulsion layer in the yellow dye image providing layer unit is also preferably comprised of a high aspect ratio tabular grain siliver halide emulsion as described above, but the use of other, conventional silver halide emulsions in the yellow dye providing layer unit together with high aspect ratio tabular grain silver halide emulsions in the cyan and megenta dye providing layer units is also specifically contemplated.

Depending upon the dye image providing material employed, it can be incorporated in the silver halide emulsion layer or in a separate layer associated with the emulsion layer. The dye image providing material can be any of a number known in the art, such as dye forming couplers, dye or dye precursor developers, and dye releasers, and the particular one employed will depend on the nature of the element or film unit and the type of image desired. Materials useful in diffusion transfer film units contain a dye moiety and a monitoring moiety. The monitoring moiety, in the presence of the alkaline prcessing solution and as a function of silver halide development, is responsible for a change in mobility of the dye moiety.

These dye image providing materials can be initially mobile and rendered immobile as a function of silver halide development, as described in Rogers U.S. Pat. Nos. 2,774,668 and 2,983,606. Idelson et al U.S. Pat. No. 3,307,947, Dershowitz et al U.S. Pat. No. 3,230,085, Cieciuch et al U.S. Pat. No. 3,579,334, Yutzy U.S. Pat. No. 2,756,142, Harbison Def. Pub. No. T889,017, and Bush et al U.S. Pat. No. 3,854,945. In a variant form a dye moiety can be attached to an initially mobile coupler. Oxidation of a paraphenylenediamine or hydroquinone developing agent can result in a reaction between the oxidized developing agent and the dye containing a coupler to form an immobile compound. Such systems are illustrated by Rogers U.S. Pat. Nos. 2,774,668 and 3,087,817, Greenhalgh et al U.K. Pat. Nos. 1,157,501-506, Puschel et al U.S. Pat. No. 3,844,785, Stewart et al U.S. Pat. No. 3,653,896, Gehin et al French Pat. No. 2,287,711, and *Research Disclosure,* Vol. 145, May, 1976, Item 14521.

Alternatively, the dye image providing materials can be initially immobile and rendered mobile, in the presence of an alkaline processing solution, as a function of silver halide development. This latter class of materials include dye releasing compounds. In such compounds, the monitoring group is a carrier from which the dye is released as a direct function of silver halide development or as an inverse function of silver halide development. Compounds which release dye as a direct function of silver halide development are referred to as negative working release compound, while compounds which release dye as an inverse function of silver halide development are referred to as positive working release compounds.

Preferred release compounds are redox dye releasers; however dye release by other mechanisms is known. For example, it is known that when silver halide is imagewise developed the residual silver ions associated with the undeveloped silver halide can react with a dye substituted ballasted thiazolidine to release a mobile dye imagewise, as illustrated by Cieciuch et al U.S. Pat. Nos. 3,719,489, 4,060,417, and 4,098,783 and Rogers U.S. Pat. No. 3,443,941.

A preferred class of positive working redox release compounds are the nitrobenzene and quinone compounds described in Chasman et al U.S. Pat. No. 4,139,379. In these compounds the dye moiety is attached to an electrophilic cleavage group, such as a carbamate group, ortho to the nitro group or the quinone oxygen, and is released upon reduction of the compound by an electron donor compound contained in the element or the processing composition. In areas where the electron donor compound is consumed by developing silver halide, no dye moiety is released.

Other useful positive working redox release compounds are the hydroquinones described in Fields et al U.S. Pat. No. 3,980,479 and the benziosoxazolone compounds described in Hinshaw et al U.S. Pat. No. 4,199,354.

A preferred class of negative working redox release compounds are the ortho or para sulfonamidophenols and naphthols described in Fleckenstein U.S. Pat. No. 4,054,312, Koyama et al U.S. Pat. No. 4,055,428, and Fleckenstein et al U.S. Pat. No. 4,076,529. In these compounds the dye moiety is attached to a sulfonamido group which is ortho or para to the phenolic hydroxy group and is released by hydrolysis after oxidation of the sulfonamido compound during development.

Another preferred class of negative working release compounds are ballasted dye forming (chromogenic) or non-dye forming (nonchromogenic) couplers having a mobile dye attached to a coupling off site. Upon coupling with an oxidized color developing agent, such as a para-phenylenediamine, the mobile dye is displaced so that it can transfer to a receiver. The use of such negative working dye image providing compounds is illustrated by Whitmore et al U.S. Pat. No. 3,227,550, Whitmore U.S. Pat. No. 3,227,552, and Fujiwhara et al U.K. Pat. No. 1,445,797, the disclosures of which are here incorporated by reference.

Since the silver halide emulsions employed in the image transfer film units of the present invention are negative working, the use of negative working release compounds will produce negative transferred dye images. In order to obtain a positive transferred dye image using nagative working release compounds, known image reversing film unit and processing variations can be employed, such as illustrated by Faul et al U.S. Pat. No. 3,998,637 and Morgan et al U.S. Pat. No. 4,258,117.

Further details regarding the above release compounds, the manner in which they function, and the procedures by which they can be prepared are contained in the patents referred to above, the disclosures of which are incorporated herein by reference.

Any material can be employed as the dye receiving layer in the film units of this invention as long as it will mordant or otherwise immobilize the dye which diffuses to it. The optimum material chosen will, of course, depend upon the specific dye or dyes to be mordanted. The dye receiving layer can also contain ultraviolet absorbers to protect the dye image from fading due to ultraviolet light, brighteners, and similar materials to protect or enhance the dye image. A polyvalent metal, preferably immobilized by association with a polymer, can be placed in or adjacent the receiving layer to chelate the transferred image dye, as taught by Archie et al U.S. Pat. No. 4,239,849 and Myers et al U.S. Pat. No. 4,241,163. Useful dye receiving layers and materials for their fabrication are disclosed in *Research Disclosure* Item 15162 and Morgan et al U.S. Pat. No. 4,258,117.

The alkaline processing composition employed in the dye image transfer film units can be an aqueous solution of an alkaline material, such as an alkali metal hydroxide or carbonate (e.g., sodium hydroxide or sodium carbonate) or an amine (e.g., diethylamine). Preferably the alkaline composition has a pH in excess of 11. Suitable materials for use in such compositions are disclosed in *Research Disclosure,* Item 15162, cited above.

A developing agent is preferably contained in the alkaline processing composition, although it can be contained in a separate solution or process sheet, or it can be incorporated in any processing solution penetrable layer of the film unit. When the developing agent is separate from the alkaline processing composition, the alkaline composition serves to activate the developing agent and provide a medium in which the developing agent can contact and develop silver halide.

A variety of silver halide developing agents can be used in processing the film units of this invention. The choice of an optimum developing agent will depend on the type of film unit with which it is used and the particular dye image providing material employed. Suitable developing agents can be selected from such compounds as hydroquinone, aminophenols (e.g., N-methylaminophenol), 1-phenyl-3-pyrazolidinone, 1-phenyl-4,4-dimethyl-3-pyrazolidinone, 1-phenyl-4-methyl-4-hydroxymethyl-3-pyrazolidinone, and N,N,N',N'-tetramethyl-p-phenylenediamine. The nonchromogenic developers in this list are preferred for use in dye transfer film units, since they have a reduced propensity to stain dye image receiving layers. All of these same developing agents are also useful in the silver transfer film units.

TABULAR GRAIN INFLUENCE ON PROCESSING RATES

It has been demonstrated that reduced access time is an advantage that can be realized with the dye image transfer film units of the present invention containing initially immobile negative working dye image providing materials. Without being bound by any particular theory, it is believed that the geometrical configuration of the tabular silver halide grains accounts for rapid access of the transferred images. Tabular grain geometry provides a very high surface area to the silver halide grains as compared to their volume, and this in turn is believed to influence their rate of development. In image transfer processes it is the imagewise variation in development of the silver halide grains as a function of their imagewise exposure which modulates the transferred image. In systems employing initially immobile negative working dye image providing materials, such as those described above, silver halide development is directly related to transferred image dye. The faster the silver halide develops, the faster the image dye becomes available for transfer.

The use of tabular grains to reduce the time elapsed between the commencement of processing and obtaining a transferred dye image—i.e., access time—in no way precludes the use of conventional image transfer film unit features which are known to reduce access time. When the present invention is employed in combination with conventional features for reducing access time at least additive results can be normally expected. In addition, there are still other features unique to the image transfer film units of this invention which can contribute to reduced access time.

A second advantage believed to be attainable with the image transfer film units of the present invention containing at least one high aspect ratio tabular grain silver haloiodide (preferably silver bromoiodide) emulsion layer is the reduced variance of the transferred image as a function of temperature. This reduced variance in the transferred image is a direct result of employing one or more tabular grain emulsion layers, as described above, wherein the tabular grains contain at least about 2 mole percent iodide. Without being bound by any particular theory, it is believed that the tabular silver haloiodide grains shown less variation in their development rates as a function of temperature. In image transfer systems in which silver haloiodide development is directly related to transferred imaging materials this reduced temperature dependence of tabular silver haloiodide grains results directly in reduced variance in the viewed image. In systems relying also upon competing mechanisms for generation of the viewable image, reduced silver haloiodide development variance as a function of temperature can reduce variance in the transferred image to the extent it is attributable to silver halide development variance and to the extent it complements temperature variances in the competing mechanisms employed in imaging.

TABULAR GRAIN INFLUENCE ON DENSITY RELATIONSHIPS

It has been demonstrated that when initially immobile negative working dye image providing materials are employed in combination with negative working high aspect ratio tabular grain emulsions reductions in minimum density, increases in maximum density for a limited time of development, and greater image discrimination can be realized. Initially immobile dye image providing materials were originally developed in the art for use with direct positive silver halide emulsions, specifically internal latent image desensitized emulsions, so that the two in combination could be used to produce transferred positive dye images. From time to time the substitution of negative working silver halide emulsions has been investigated for specialized applications. Although success has been realized in substituting relatively low speed negative working silver halide emulsions, minimum densities elevated to unacceptable levels for common imaging applications have been encountered when camera speed (an I.S.O speed of 25 or higher) negative working emulsions, such as silver bromoiodide emulsions, are substituted for direct positive emulsions in image transfer film units containing initially immobile negative working dye image providing materials, such as redox dye releasers. The avoidance of elevated minimum densities by employing negative working high aspect ratio tabular grain emulsions is surprising. When the relatively lower minimum densities realized are coupled with high maximum densities for a limited time of development, the result is greater image discrimination. The latter characteristic is desirable in that it allows simultaneously minimum density areas to be whiter, maximum density areas to be more color saturated, and a greater gradation of the color scale between maximum and minimum densities.

TABULAR GRAIN INFLUENCE ON SILVER COVERAGES

It has been surprisingly observed that the dye image transfer film units of the present invention incorporating initially immobile positive working dye image providing materials exhibit substantially higher photographic speeds at lower silver coverages than comparable conventional dye image transfer film units. It is well known to those skilled in the art that silver coverages below a threshold level result in reduction of observed photographic speed as determined from a transferred dye image. While speed decreases still occur when silver coverages in the image transfer film units of this invention are reduced, the speed reduction is much more gradual when negative working high aspect ratio tabular grain emulsions are employed in combination with initially immobile positive working dye image providing matrials, thereby allowing lower silver coverages. It has been additionally observed that the dye image transfer film units of the present invention incorporating initially mobile positive working dye image providing materials exhibit substantially lower minimum densities at lower silver coverages than comparable conventional dye image transfer film units. It is believed that the more rapid onset of development with high aspect ratio tabular grain emulsions may account for both the speed and minimum density advantages observed by employing negative working high aspect ratio tabular grain emulsions in combination with positive working dye image providing materials in image transfer film units. More specifically, it is believed that the more rapid onset of development with high aspect ratio tabular grain emulsions further reduces the small amounts of initially mobile dye image providing materials that are conventionally transferred in areas receiving maximum exposure during imaging. Since speed is generally determined by the grains most responsive to exposure and processing the more rapid onset of development with high aspect ratio tabular grains may also account for the relatively high speeds observed at reduced silver coverages.

Acceptable photographic speeds and minimum densities in conventional multicolor image transfer film units are commonly obtained by employing silver halide in each of the yellow, magenta, and cyan dye providing layer units at silver coverages of about 1000 mg/m$^2$ or higher. It is specifically contemplated to employ substantially lower silver coverages in the practice of this invention. When the silver halide emulsion in the yellow, magenta, or cyan dye providing layer unit of the dye image transfer film unit of this invention is a negative working high aspect ratio tabular grain emulsion as described above, it can be efficiently employed at silver coverages of from about 150 to 750 mg/m$^2$, preferably from about 200 to 700 mg/m$^2$, and optimally from about 300 to 650 mg/m$^2$ in combination with initially immobile positive working dye image providing materials. At higher and lower silver coverages higher and lower photographic speeds, respectively, will be realized, the stated ranges reflecting an efficient balance of photographic performance and silver coverages for most imaging applications. When the image transfer film unit contains a single dye providing layer unit containing tabular silver halide grains, then these coverages are applicable to that of a single dye providing layer unit. When all three dye providing layer units contain tabular silver halide emulsions, at least additive silver savings can be realized.

LAYER ORDER ARRANGEMENTS

The image transfer film units of this invention can employ any layer order arrangement heretofore known to be useful in conventional image transfer film units having one or more radiation sensitive silver halide emulsion layers. In addition, the distinctive properties of tabular silver halide emulsions make possible highly advantageous layer order arrangements not heretofore known to the art. The following specific layer order arrangements are merely illustrative, many other arrangements being additionally contemplated:

To avoid unnecessary repetition, discussion of each successive layer order arrangement is directed to features which are distinctive as compared to prior layer order arrangements. Stated another way, features and advantages shared by the layer order arrangements are fully discussed only in connection with the first layer order arrangement in which they appear. If a feature or advantage is not shared by a subsequently described layer order arrangement, this is specifically pointed out.

| Layer Order Arrangement I |
|---|
| A Laminate and Peel Apart Dye Image Transfer Film Unit |
| Reflective Support |
| Dye Receiving Layer |
| Imagewise Exposure |
| ↓ |
| Tabular Silver Halide Emulsion Layer With Dye Image Providing Material |
| Support |

Layer Order Arrangement I is illustrative of a conventional laminate and peel apart dye image transfer film unit. Upon imagewise exposure, the negative working tabular silver halide emulsion layer produces a developable latent image. The dye receiving layer containing a mordant is laminated and an alkaline processing composition, not shown, is released between the dye receiving layer and emulsion layer following exposure. Development of the tabular silver halide grains bearing latent image sites occurs upon contact with the alkaline processing composition. Depending upon whether a positive working or negative working dye image providing material is employed, positive or negative transferred dye image is produced in the receiving layer. Processing is terminated by peeling the reflective support having the silver receiving layer coated thereon from the remainder of the image transfer film unit.

While the layer order arrangement is conventional and employs conventional materials except for the tabular silver halide emulsion layer, significantly superior results are obtainable. The access time required to produce a substantially fully transferred dye image in the receiving layer can be reduced for reasons previously discussed. In addition, a second characteristic of tabular grain emulsions can be used to reduce further image access times. While high aspect ratio tabular grain emulsion layers can be coated in the same layer thicknesses as conventional emulsions without departing from the teachings of this invention, it is preferred to thin the high aspect ratio tabular grain silver halide emulsion layers as compared to corresponding conventional silver halide emulsion layers. In conventional silver halide emulsions employed in image transfer the emulsion layer thickness is substantially greater than the average grain diameter calculated from the grain projected areas. Further, the thickness of the layer is large enough to accommodate not just the average grains, but the largest grains present. Thus, if the largest nontabular silver halide grains in a silver halide emulsion layer of an image transfer film unit exhibit an average diameter of from 1 to 2 microns, the emulsion layer will be at least 1 to 2 microns in thickness and will usually be substantially greater in thickness. On the other hand, it is possible to employ tabular silver halide grains as defined herein having diameters based on average projected areas of 1 to 2 microns and often still larger while the thickness of the tabular grains is less than 0.5 or even 0.3 micron. Thus, in an exemplary emulsion in which the tabular grains have an average thickness of 0.1 micron with an average diameter of 1 to 2 microns, the silver halide emulsion layer thickness can easily be reduced substantially below 1 micron. The high aspect ratio tabular grain emulsion layers of this invention are preferably less than 4 times the average thickness of the tabular grains and are optimally less than twice the average thickness of the tabular grains. Significant reductions in the thickness of the high aspect ratio tabular grain silver halide emulsion layers of the invention can contribute to reduction in image access times by reducing the lengths of diffusion paths. Further, reduction of the lengths of diffusion paths can also contribute to improvements in sharpness.

| Layer Order Arrangement II |
|---|
| An Integral Dye Image Transfer Film Unit |
| View |
| ↓ |
| Transparent Support |
| Neutralizing Layer |
| Timing Layer |
| Dye Receiving Layer |
| Reflective Layer |
| Opaque Layer |
| Tabular Silver Halide Emulsion Layer With Dye Image Providing Material |
| Alkaline Processing Composition + Opacifier |
| Transparent Support |
| ↑ |
| Imagewise Exposure |

Layer Order Arrangement II is a conventional integral format dye image transfer film unit, differing from the art solely by the incorporation of the tabular silver halide emulsion layer. Layer Order Arrangement II combines all of the advantages provided by the tabular silver halide emulsion layer, discussed above in connection with Layer Order Arrangement I and additionally provides the art recognized advantages of an integral format. Because of the presence of an opacifier in the alkaline processing solution, it is necessary to place the alkaline processing solution in the location indicated after imagewise exposure. Once in place the opacifier prevents further exposure of the emulsion layer, as can occur, for example, when the image transfer film unit is removed from a camera. Processing is terminated by the timing and neutralizing layers.

| Layer Order Arrangement III |
|---|
| An Integral Monochromatic Dye Image Transfer Film Unit |
| View |
| ↓ |
| Transparent Support |
| Dye Receiving Layer |
| Reflective Layer |
| Opaque Layer |
| Tabular Silver Halide Emulsion Layer With Dye Image Providing Material |
| Alkaline Processing Composition + Opacifier |
| Timing Layer |
| Neutralizing Layer |
| Transparent Support |
| ↑ |
| Imagewise Exposure |

Initially the alkaline processing composition containing opacifier is not present in the location shown. Therefore, upon imagewise exposure light strikes the tabular silver halide emulsion layer. This produces a latent image corresponding to light struck areas of the emulsion layer. To initiate processing the alkaline processing composition is placed in the position shown. Usually, but not necessarily, the image transfer film unit is removed from the camera in which it is exposed immediately following placement of the alkaline processing composition and opacifier. The opacifier and opaque layer together prevent further exposure of the emulsion layer. Upon development, a mobile dye or dye precursor is released from the emulsion layer. When the dye image providing material is a positive working release compound, it is released in initially unexposed areas of the emulsion layer; when the dye image providing material is a negative working release compound, the converse is true. The mobile dye or dye precursor penetrates the opaque layer and the reflective layer and is mordanted or otherwise immobilized in the dye receiving layer to permit viewing through the uppermost transparent support. Processing is terminated by the timing and neutralizing layers.

Layer Order Arrangement III differs from Layer Order Arrangement II in the location of the timing and neutralizing layers. The positions of the timing and neutralizing layers in Layer Order Arrangements II and III are interchangeable. Although not specifically illustrated, it is possible to combine both silver and dye image transfer in a single image transfer film unit, since the two are compatible. A useful application of such a combined image transfer film unit arises where the silver density is being supplemented by dye, allowing low silver coverages to be realized. Except for combined silver and dye imaging, dissolving of undeveloped silver halide is not normally undertaken in Layer Order Arrangement III and is not needed to obtain reduced transferred image access times. The presence of dye image providing material in the high aspect ratio tabular grain silver halide emulsion layer can significantly increase the thickness of this layer. As has been previously discussed, it is recognized that silver halide coverages can be significantly reduced in the high aspect ratio tabular grain silver halide emulsion layer while retaining acceptable photographic speed or minimum density levels in dye image transfer film units. Layer Order Arrangement III is capable of providing either advantage.

| Layer Order Arrangement IV |
|---|
| An Integral Multicolor Dye Image Transfer Film Unit |
| Imagewise Exposure |
| ↓ |
| Transparent Support |
| Neutralizing Layer |
| Timing Layer |
| Alkaline Processing Composition + Opacifier |
| Transparent Overcoat |
| Blue sensitive Tabular Silver Halide Emulsion Layer |
| Yellow Dye Image Providing Material Layer |
| Interlayer With Scavenger |
| Green sensitive Tabular Silver Halide Emulsion Layer |
| Magenta Dye Image Providing Material Layer |
| Interlayer With Scavenger |
| Red sensitive Tabular Silver Halide Emulsion Layer |
| Cyan Dye Image Providing Material Layer |
| Opaque Layer |
| Reflective Layer |
| Dye Receiving Layer |
| Transparent Support |
| ↑ |
| View |

Layer Order Arrangement IV is essentially similar to Layer Order Arrangement III, but is modified to contain three separate dye providing layer units, each comprised of one high aspect ratio tabular grain silver halide emulsion layer and one dye image providing material layer, instead of the single dye image providing material containing high aspect ratio tabular grain silver halide emulsion layer of Layer Order Arrangement III. (Whether or not the dye image providing material is placed in the emulsion layer itself or in an adjacent layer in Layer Order Arrangements III and IV is a matter of choice, either arrangement being feasible.)

To prevent color contamination of adjacent dye providing layer units, an interlayer containing a scavenger is positioned between dye providing layer units. The use of scavengers in interlayers is taught by Weissberger et al U.S. Pat. No. 2,336,327 and in the dye providing layer units themselves by Yutzy et al U.S. Pat. No. 2,937,086. The use of scavengers in either or both locations is contemplated.

In a modification of Layer Order Arrangement IV it is possible to eliminate the interlayers. Since the high aspect ratio tabular grain silver halide emulsion layers can be quite thin in comparison to conventional silver halide emulsion layers typically employed in multicolor dye image transfer film units, each high aspect ratio tabular grain silver halide emulsion layer can be coated between two dye image providing material layers. The two dye image providing material layers preferably do not contain scavenger, but can contain scavenger, if desired, depending upon the sensitivity of the imaging application to color contamination and the specific choice of dye image providing materials. Providing dye image providing layers adjacent both sides of each high aspect ratio tabular grain silver halide emulsion layer provides a close association between the dye image providing materials and the silver halide. This arrangement is most advantageous where the dye image providing materials of each dye providing layer unit is initially colorless or at least shifted in hue so that the dye image providing material is not adsorbing in the spectral region to which the silver halide is intended to respond.

Where the yellow dye image providing material is initially yellow, it acts, together with the blue sensitive high aspect ratio tabular grain silver halide emulsion layer, to intercept blue light that would otherwise reach the green and red sensitive high aspect ratio tabular grain silver halide emulsion layers. Where the green and red sensitive silver halide emulsion layers employ silver bromide or silver bromoiodide grains in a conventional multicolor dye image transfer film unit, it is necessary to intercept blue light to avoid color contamination of the green and red sensitive emulsion layers. However, where the green and red sensitive emulsions are high aspect ratio tabular grain, it is unnecessary to filter blue light so that it is attenuated before reaching these emulsion layers. Thus, where the yellow dye image providing material is initially colorless or at least nonabsorbing in the blue region of the spectrum, it is still possible for accurate color reproduction to occur in the magenta and cyan dye providing layer units without any necessity of interposing a yellow filter layer. Further, as is more fully described below, the dye providing color forming layer units can be located in any desired order.

| Layer Order Arrangement V |
|---|
| An Integral Multicolor |
| Dye Image Transfer Film Unit |
| Opaque Support |
| Yellow Dye Image Providing Material Layer |
| Blue sensitive Tabular Silver |
| Halide Emulsion Layer |
| Interlayer With Scavenger |
| Cyan Dye Image Providing Material Layer |
| Red sensitive Tabular Silver |
| Halide Emulsion Layer |
| Interlayer With Scavenger |
| Magenta Dye Image Providing Material Layer |
| Green sensitive Tabular Silver |
| Halide Emulsion Layer |
| Transparent Overcoat |
| Alkaline Processing Composition With |
| Reflective Material and Indicator Dye |
| Dye Receiving Layer |
| Timing Layer |
| Neutralizing Layer |
| Transparent Support |
| ↑ |
| View and Imagewise Exposure |

In Layer Order Arrangement V during imagewise exposure the alkaline processing composition containing the reflective material and indicator dye is not in the position shown, but is released to the position shown after exposure to permit processing. The indicator dye exhibits a high density at the elevated levels of pH under which processing occurs. It thereby protects the silver halide emulsion layers from further exposure if the film unit is removed from a camera during processing. Once the neutralizing layer reduces the pH within the film unit to terminate processing, the indicator dye reverts to an essentially colorless form. The alkaline processing composition also contains a reflective material, which provides a background for viewing the transferred dye image after processing.

Layer Order Arrangement V is illustrative of the application of the invention to an integral multicolor dye image transfer film unit format in which imagewise exposure and viewing occur through the same support. Layer Order Arrangement V differs from the prior teachings of the art not only in the use of high aspect ratio tabular grain silver halide emulsions, but also in the order in which the dye providing layer units are arranged. The green sensitive high aspect ratio tabular grain silver halide emulsion layer is nearest to the exposing radiation source while the blue sensitive high aspect ratio tabular grain silver halide emulsion layer is farthest removed. This arrangement is possible without color contamination because of the relatively large separations in blue and minus blue response attainable with minus blue spectrally sensitized high aspect ratio tabular grain silver halide emulsions. By placing the magenta dye providing layer unit nearest the source of exposing radiation and nearest the dye receiving layer, the sharpness of the magenta dye image is improved and its access time is reduced. The magenta dye image is, of course, the visually most important component of the multicolor dye image. The cyan image is the visually second most important, and its location is also nearer the exposing radiation source and the dye receiving layer than in a corresponding conventional dye image transfer film unit. Thus, significant advantages in terms of reduced image access time and increased image sharpness are attainable with Layer Order Arrangement V in addition to those improvements attributable to high aspect ratio tabular grain silver halide grains previously discussed above in connection with other layer order arrangements. While Layer Order Arrangement V is useful with all high aspect ratio tabular grain silver halides, it is particularly advantageous with high aspect ratio tabular grain silver bromide or bromoiodide.

| Layer Order Arrangement VI |
|---|
| An Integral Multicolor |
| Dye Image Transfer Film Unit |
| With Image Reversal |
| Expose |
| ↓ |
| Transparent Support |
| Neutralizing Layer |
| Timing Layer |
| Alkaline Processing Composition + Opacifier |
| Green sensitive Tabular Silver |
| Halide Emulsion Layer |
| Interlayer With Scavenger |
| Magenta Dye Image Providing Material and Nuclei |
| Interlayer With Scavenger and Nuclei |
| Red sensitive Tabular Silver |
| Halide Emulsion Layer |
| Interlayer With Scavenger |
| Cyan Dye Image Providing Material and Nuclei |
| Interlayer With Scavenger and Nuclei |
| Blue sensitive Tabular Silver |
| Halide Emulsion Layer |
| Interlayer With Scavenger |
| Yellow Dye Image Providing Material and Nuclei |
| Opaque Layer |
| Reflective Layer |
| Dye Receiving Layer |
| Transparent Support |
| ↑ |
| View |

During imagewise exposure of Layer Order Arrangement VI the alkaline processing composition containing the opacifier is not in the location shown. The alkaline processing composition is placed in the position shown to commence processing. Initially each of the high aspect ratio tabular grain silver halide emulsion layers develop in the areas which are light struck during exposure. The emulsion layers each contain a scavenger to prevent any interaction of the oxidized developing agent produced by development of the light struck silver halide and the dye image providing materials. A scavenger containing interlayer is also positioned between each high aspect ratio tabular grain silver halide emulsion layer and its co In the areas of the high aspect ratio tabular grain silver halide emulsion layers in which silver halide development does not occur, silver halide is solubilized by silver halide solvent contained in the alkaline processing composition. The solubilized silver halide migrates through the adjacent interlayer containing scavenger and is converted to silver on the nuclei present in the layer containing the dye image providing material. The nuclei can be those employed for physical development in silver image transfer. The oxidized developing agent produced as a result of physical development is free to react with the dye image providing material to release a mobile dye or dye precursor. Color contamination between adjacent dye providing layer units is prevented by interposing therebetween a layer containing a scavenger to prevent the migration of oxidized developing agent therethrough and nuclei to prevent the migration of solubilized silver halide therethrough.

Layer Order Arrangement VI is illustrative of an integral multicolor dye image transfer film unit which produces a positive transferred dye image using negative working silver halide emulsions and negative working release compounds materials. Although the basic approach has been previously disclosed in the art, as illustrated by U.K. Patent 904,364, there are unexpected advantages to employing high aspect ratio tabular grain silver halide emulsions as herein described. It is to be noted that both the development and solubilizing of silver halide is required to obtain a transferred dye image. Because of the increased rates of development and solubilizing possible with high aspect ratio tabular grain silver halide emulsions, it is possible to reduce transferred image access times below those that have been previously obtained with ths type of image reversal arrangement. Layer Order Arrangement VI also exhibits advantages attributable to a dye providing layer unit arrangement similar to those already described in connection with Layer Order Arrangement V.

Although the invention has been particularly described with reference to certain preferred layer order arrangements, it is appreciated that the high aspect ratio tabular grain silver halide emulsions need not always be present as planar, uninterrupted layers. Rather than being continuous, the layers can be subdivided into discrete laterally displaced portions or segments. In multicolor image transfer film units the layers need not be superimposed, but can be present in the form of interlaid layer segments. It is specifically contemplated to employ high aspect ratio tabular grain silver halide emulsions as herein disclosed in microcellular image transfer film unit arrangements, such as disclosed by Whitmore Patent Cooperation Treaty published application No. W080/01614, published Aug. 7, 1980, here incorporated by reference. The present invention is also fully applicable to microcellular image transfer film units containing microcells which are improvements on Whitmore, such as Gilmour U.S. Pat. No. 4,386,145; Blazey et al U.S. Pat. No. 4,307,165; and Gilmour et al U.S. Pat. No. 4,411,973, the disclosures of which are here incorporated by reference.

Although all of the advantages attributable to high aspect ratio tabular grain silver halide emulsions can be realized in microcellular image transfer film units, the large minus blue and blue speed separations obtainable with spectrally sensitized high aspect ratio tabular grain silver halide emulsions, most notably silver bromide and bromoiodide emulsions, are particularly advantageous in microcellular image transfer film units intended to produce multicolor images. Since the microcell triads intended to respond to blue, green, and red light are positioned to receive the same incident light, yellow filters are interposed using conventional silver bromide and bromoiodide emulsions to improve minus blue and blue speed separation. This can involve an additional coating or cell filling step and reduce photographic speed. The high aspect ratio tabular grain silver halide emulsions can be employed in multicolor microcellular image transfer film units without the use of yellow filters, thereby significantly simplifying construction and improving performance.

As will be readily apparent to those skilled in the art the image transfer film units can contain a variety of conventional addenda not specifically discussed above. For example, the image transfer film units can contain brighteners, antifoggants, stabilizers, scattering or absorbing materials, hardeners, coating aids, plasticizers, lubricants, and matting agents, as described in *Research Disclosure* Item 17643, Paragraphs V, VI, VIII, X, XI, XII, and XVI. Methods of addition and coating and drying procedures can be employed, as described in Paragraphs XIV and XV. Conventional photographic supports can be employed, as described in Paragraph XVII. Other compatible conventional features, not specifically described, will be readily apparent to those skilled in the art.

EXAMPLES

The invention can be better appreciated by reference to the following illustrative examples.

In each of the examples the term "percent" means percent by weight, unless otherwise indicated, and the term "M" stands for molar concentration, unless otherwise indicated. All solutions, unless otherwise indicated, are aqueous solutions. Although some tabular grains of less than 0.6 micron in diameter were included in computing the tabular grain average diameters and percent projected area in the example emulsions, except where their exclusion is specifically noted, insufficient small diameter tabular grains were present to alter significantly the numbers reported.

EXAMPLE 1

Control Emulsion C-1

A conventional low aspect ratio silver bromoiodide control emulsion having an average grain diameter of 1.1 microns and containing 9 mole percent iodide was prepared as described in Illingsworth U.S. Pat. No. 3,320,069. The emulsion was optimally sensitized with sulfur and gold in the presence of thiocyanate and spectrally sensitized to green light using a sensitizing combination of carbocyanine dyes.

Tabular Grain Emulsion T-1

A high aspect ratio tabular grain silver bromide emulsion containing tabular silver bromide grains having an average grain diameter of 4 microns, an average grain thickness of 0.13 micron, and an average aspect ratio of approximately 30:1 was prepared. The tabular silver bromide grains accounted for approximately 90 percent of the total grain projected area. The emulsion was optimally sensitized chemically with sulfur and gold in the presence of thiocyanate and spectrally sensitized with the same sensitizing dye combination employed in Control Emulsion C-1.

Dye Image Transfer Film Units

Control Emulsion C-1 was coated on a support having an antihalation layer in a decreasing silver coverage series (1.38, 0.69, 0.53, and 0.36 g/m$^2$) along with the materials shown below:

| | Coverage |
|---|---|
| Positive Redox Dye Releaser 1 | 0.69 g/m$^2$ |
| Incorporated Reducing Agent 2 | 0.42 g/m$^2$ |
| Incorporated Inhibitor 3 | 0.009 g/m$^2$ |
| 4-Hydroxy-6-methyl-1,3,3a,7-tetraazaindene | 1.2 g/Ag mole |
| Gelatin | 1.1 g/m$^2$ |

In addition to the gelatin shown in Table I, for each gram of silver coated, an equal weight of gelatin was also present in the coating.

Tabular grain Emulsion T-1 of the invention was coated on a clear cellulose acetate support in a decreasing silver coverage series (1.35, 0.67, and 0.40 g/m$^2$) along with the materials shown below:

| | Coverage |
|---|---|
| Positive Redox Dye Releaser 1 | 0.80 g/m$^2$ |
| Incorporated Reducing Agent 2 | 0.37 g/m$^2$ |
| Incorporated Inhibitor 3 | 0.01 g/m$^2$ |
| 4-Hydroxy-6-methyl-1,3,3a,7-tetraazaindene | 3.6 g/Ag mole |
| Gelatin | 1.2 g/m$^2$ |

In addition to the gelatin shown in Table I, for each gram of silver coated, an equal weight of gelatin was also present in the coating.

Positive Redox Dye Releaser 1 (PRDR-1)

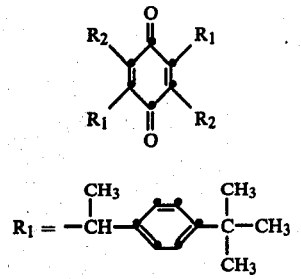

-continued

Positive Redox Dye Releaser 1 (PRDR-1)

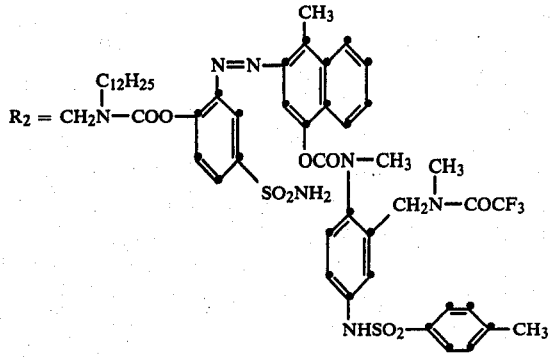

Dispersed in diethyllauramide Solid:solvent 1:1

Incorporated Reducing Agent 2 (IRA-2)

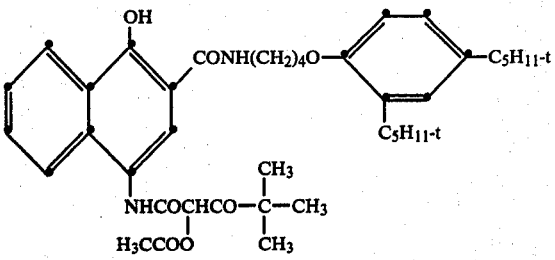

Dispersed in diethyllauramide Solid:solvent 2:1

Inhibitor 3 (INH-3)

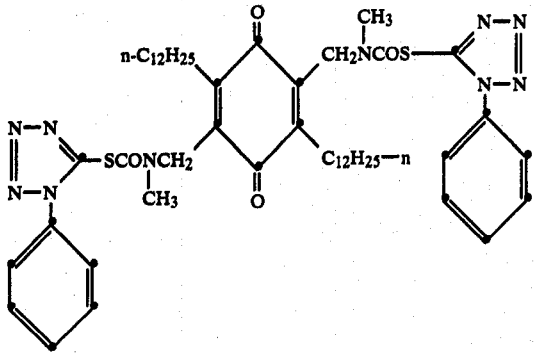

Dispersed in diethyllauramide Solid:solvent 2:1

Dye Image Receiver

The dye image receiver consisted of the following structure. Coverages are shown parenthetically in g/m$^2$.

6. Hydroxyethylcellulose layer (Natrosol 250L) (0.97)
5. Gelatin Layer (1.1)
4. Opaque layer: Carbon (1.9), Gelatin (1.1)
3. Reflecting layer: Titanium dioxide (19), Gelatin (3.0)
2. Mordant layer: Poly(4-vinylpyridine) (2.2), Gelatin (2.2)
1. Metal containing layer: Nickel sulfate hexahydrate (0.58), gelatin (1.1)

Coated on clear polyester support in the order of numbering.

Exposure and Processing

The dye image transfer film units described above were exposed for 1/100 second to a 600 watt 2850° K. tungsten light source through a step chart, a 1.0 neutral density filter and a Wratten 16 filter.

The dye image transfer film units were processed by releasing processing fluid from a pod to the interface of the dye receiver and the emulsion layer by laminating between stainless steel rollers providing a 75 micron developer layer thickness. The processing composition for Control Emulsion C-1 (Pod L) is shown below in Example 2. The composition of the pod for Tabular Grain Emulsion T-1 was identical to Pod L, except it contained 16 grams/liter of the 3-pyrazolidinone electron transfer agent rather than 8 grams/liter.

In both instances transfers were carried out for 10 minutes at room temperature. The receivers were separated and the Status A green density was read. Characteristic curves were plotted, and relative speeds were determined at 0.2 density units below maximum density.

The sensitometric results obtained are shown below. Of particular interest are the relative threshold speeds at decreasing silver coverages for the two emulsions. The tabular grain emulsion coating maintained significantly higher relative speeds as the silver coverage was reduced compared to the conventional three-dimensional emulsion coating.

TABLE I

| Coating/Ag Coverage | $D_{max}$ | $D_{min}$ | Contrast | Relative Speed* |
|---|---|---|---|---|
| Control Emulsion C-1 | | | | |
| 1.38 g/m² | 1.74 | 0.16 | 1.7 | 100 |
| 0.69 g/m² | 2.04 | 0.17 | 2.2 | 59 |
| 0.53 g/m² | 2.11 | 0.13 | 2.4 | 51 |
| 0.36 g/m² | 2.16 | 0.17 | 2.3 | 24 |
| Tabular Grain Emulsion T-1 | | | | |
| 1.35 g/m² | 1.04 | 0.12 | 1.2 | 100 |
| 0.67 g/m² | 1.44 | 0.12 | 1.8 | 90 |
| 0.40 g/m² | 1.77 | 0.10 | 2.1 | 88 |

*30 = 0.3 log E.

The effect is also shown graphically in FIG. 1.

EXAMPLE 2

Control Emulsion C-2

A conventional low aspect ratio polydisperse silver bromoiodide emulsion containing some large grains up to about 2 microns and containing 6.2 mole percent iodide was prepared as described in Illingsworth U.S. Pat. No. 3,320,069. The emulsion was optimally chemically sensitized with sulfur and gold in the presence of thiocyanate and spectrally sensitized to green light using the same sensitizers employed with the tabular grain emulsion, Tabular Grain Emulsion T-2, described below.

Tabular Grain Emulsion T-2

A high aspect ratio tabular silver bromoiodide emulsion having an average grain diameter of 4.7 microns, an average grain thickness of 0.16 micron, and an average aspect ratio of 29:1 was prepared. The tabular silver bromide grains accounted for greater than 95 percent of the total projected grain area. The emulsion was optimally sensitized chemically with sulfur and gold in the presence of thiocyanate and spectrally sensitized to green light using a sensitizing combination of carbocyanine dyes.

Dye Image Transfer Film Units

Integral imaging receivers (IIR's) using the above emulsions of the following structure were prepared. Coverages are in (g/m²) unless otherwise specified.

7. Hydroxyethylcellulose (Natrosol 250L) overcoat layer (0.54)
6. Magenta imaging layer: Green sensitized negative silver halide Tabular Grain Emulsion T-2 (0.74 Ag), Redox Dye Releaser 1 (0.67), Reducing Agent 2 (0.36), Inhibitor 3 (0.009), 4-hydroxy-6-methyl-1,3,3a,7-tetraazaindene (3.5 g/Ag mole), gelatin (1.7)
5. Gelatin interlayer (1.2)
4. Opaque layer: Carbon (1.9), gelatin (1.2)
3. Reflecting layer: Titanium dioxide (16.0), gelatin (2.6)
2. Mordant layer: Poly(4-vinylpyridine) (2.2), gelatin (2.2)
1. Metal containing layer: Nickel sulfate hexahydrate (0.58), gelatin (1.1)

Coated on clear polyester support in the order of numbering.

A control was the same as the example coating described above, except Control Emulsion A-2 was used at 1.48 g Ag/m². Both coatings were hardened with bis(vinylsulfonyl)methane at 1.1 percent of the gelatin weight.

Cover sheets of the following structure were prepared:

2. Timing layer: 1:1 physical mixture of the following two polymers coated at 4.8 g/m²: Poly(acrylonitrile-co-vinylidene chloride-co-acrylic acid) at a 14:79:7 weight ratio The carboxy ester lactone formed by cyclization of a vinyl acetate-maleic anhydride copolymer in the presence of 1-butanol to produce a partial butyl ester of acid:ester of 15:85
1. Acid layer: Poly(n-butyl acrylate-co-acrylic acid) at a 30:70 weight ratio equivalent to 140 meq acid/m²

Coated on clear polyester support in the order numbered.

Processing pods of the following two compositions were prepared:

| | Pod L | Pod M |
|---|---|---|
| Potassium hydroxide | 60 g/l | 60 g/l |
| 4-Hydroxymethyl-4-methyl-1-phenyl-3-pyrazolidinone | 8 g/l | 6 g/l |
| Potassium bromide | 5 g/l | 10 g/l |
| Sodium sulfite | 2 g/l | 2 g/l |
| Carboxymethylcellulose | 57 g/l | 57 g/l |

Exposure and Processing

Each integral imaging receiver (IIR) was exposed in a sensitometer to yield a full-scale $D_{min}/D_{max}$ image after processing with a viscous processing composition in a pod. The processing composition was spread between the IIR and the cover sheet using a pair of rollers which provide a 100 μm gap. Within 12 to 24 hours the Status A green density of the receiver side of the IIR was read to obtain the sensitometric curves. The sensitometric parameters, $D_{max}$, $D_{min}$, contrast, and relative speed (at D=0.3 below $D_{max}$) were read from the curves.

As the data in Table II below shows, the Tabular Grain Emulsion T-2, with either pod L, or the less active M pod, produced a relative speed that was 0.2 log E faster than the control emulsion processed with the same pod, despite the much lower silver coverage (0.74 g Ag/m$^2$ versus 1.48 g Ag/m$^2$) of the tabular grain emulsion. The speed difference was even greater, 0.4 log E, when comparing the two emulsions at more nearly equal maximum densities. At the direct viewing conditions (1:1 magnification) normally used for products of this type, there was no difference in graininess apparent upon visual inspection.

TABLE II

| Emulsion | Pod | $D_G$-max | $D_G$-min | Green Contrast | Relative Green Speed |
|---|---|---|---|---|---|
| Control C-2 | L | 1.3 | 0.13 | 1.4 | 100 |
| Tabular Grain Emulsion T-2 | L | 1.8 | 0.13 | 2.0 | 119 |
| Control C-2 | M | 1.6 | 0.13 | 1.6 | 77 |
| Tabular Grain Emulsion T-2 | M | 1.9 | 0.13 | 1.8 | 99 |

EXAMPLE 3

A multicolor integral imaging receiver (IIR) of the following structure was prepared:

11. Overcoat layer
10. Yellow imaging layer
9. Interlayer
8. Magenta imaging layer: Green sensitized negative silver bromoiodide Tabular Grain Emulsion T-3 (a remake of Tabular Grain Emulsion T-2) (0.65 Ag), Positive Redox Dye Releaser 1 (0.63), Reducing Agent 2 (0.32), Inhibitor 3 (0.010), 4-hydroxy-6-methyl-1,3,3a,7-tetraazaindene (3.6 g/Ag mole), gelatin (1.3)
7. Interlayer
6. Cyan imaging layer
5. Gelatin interlayer
4. Opaque layer
3. Reflecting layer
2. Mordant layer: Poly(4-vinylpyridine) (2.2), gelatin (2.2)
1. Metal containing layer: Nickel sulfate hexahydrate (0.58), gelatin (1.1)

The layers were coated on clear polyester support in the order of numbering.

A control was similar to the example, but used a low aspect ratio silver bromoiodide emulsion, C-3, at 0.99 g Ag/m$^2$ in layer 8, the magenta imaging layer.

Both the example and the control were hardened with bis(vinylsulfonyl)methane at 0.9 percent of the gelatin weight.

The cover sheet was the same as was used for Example 2.

Processing pods of the following composition were prepared:

| | Pod N |
|---|---|
| Potassium hydroxide | 60.0 g/l |
| 4-Hydroxymethyl-4-methyl-1-p-tolyl-3-pyrazolidinone | 12.0 g/l |
| Potassium bromide | 5.0 g/l |
| Ethylenediaminetetraacetic acid, disodium salt | 10.0 g/l |
| Carboxymethylcellulose | 57.0 g/l |

The above elements were used as follows:

The multicolor integral imaging receiver (IIR) was exposed in a sensitometer to give a neutral image at a Status A density of 1.0 after processing with a viscous processing composition in a pod. The pod contents were spread between the IIR and the cover sheet using a pair of rollers which provide a 100 μm gap. Within 12 to 24 hours the Status A green density of the receiver side of the IIR was read to obtain the sensitometric curve. The green density sensitometric parameters, $D_{max}$, $D_{min}$, contrast, and relative speed (at D=0.2 below $D_{max}$) were read from the curve.

The data below in Table III shows that the Tabular Grain Emulsion T-3, had a relative speed that was almost 0.3 log E faster than the control, yet used only ⅔ the quantity of silver. Again, at the direct viewing conditions (1:1 magnification) used for products of this type, no significant difference in "observed graininess" was seen as viewed through a green filter.

TABLE III

| Emulsion | Pod | $D_G$-max | $D_G$-min | Green Contrast | Relative Green Speed |
|---|---|---|---|---|---|
| Control C-3 | N | 1.9 | 0.12 | 1.5 | 100 |
| Tabular Grain Emulsion T-3 | N | 2.0 | 0.23 | 1.4 | 127 |

EXAMPLE 4

Tabular Grain Emulsion T-4

A high aspect ratio tabular grain silver chloride emulsion having an average grain diameter of 6.0 micron, an average grain thickness of 0.28 microns and an average aspect ratio of 22:1 was prepared. The tabular silver chloride grains accounted for greater than 80 percent of the total projected area. The emulsion was optimally sensitized chemically with sulfur and gold in the presence of thiocyanate and spectrally sensitized to green light with an oxacarbocyanine dye in the presence of 3 mole percent bromide.

Dye Image Transfer Film Units

Integral imaging receivers (IIR's) using Tabular Emulsion T-4 were otherwise identical to those of Example 2.

The cover sheet and the pods L and N are the same as those of Examples 2 and 3.

The above elements were used in the manner described in Example 2.

The above IIR using Emulsion T-4 yielded a full-scale D-min/D-max image when exposed in an Eastman IB Sensitometer at 1/100 sec through a graduated density test object. This indicates that Emulsion T-4 had sufficient photographic sensitivity to be considered suitable for "camera speed" use with image transfer materials. Sensitometric parameters are tabulated below in Table IV.

TABLE IV

| Emulsion | Pod | $D_G$-max | $D_G$-min | Green Contrast |
|---|---|---|---|---|
| T-4 | L | 1.6 | ≅0.3 | 1.1 |
| T-4 | N | 1.0 | 0.31 | 0.7 |

EXAMPLE 5

TABULAR GRAIN EMULSION T-5

A high aspect ratio tabular silver bromoiodide host emulsion sensitized with silver chloride epitaxial deposition with an average grain diameter of 3.0 microns, an average grain thickness of 0.09 micron and an average aspect ratio of 33:1 was prepared. The tabular grains accounted for greater than 85 percent of the total grain surface area.

An integral imaging receiver (IIR) was prepared similar to that of Example 2, except: in layer 6, Tabular Grain Emulsion T-5 was used (0.67 Ag), and layer 5 was omitted.

The cover sheet and pod N were the same as Examples 2 and 3. The above elements were used in the same manner as described in the referenced Example 2.

The above IIR using Emulsion T-5 yielded a full-scale $D_{min}/D_{max}$ image when exposed in an Eastman IB Sensitometer at 1/100 sec through a graduated density test object. This indicates that Emulsion T-5 had sufficient photographic sensitivity to be considered suitable for "camera speed" use with image transfer materials. Sensitometric parameters are tabulated below in Table V.

TABLE V

| Emulsion | Pod | $D_G$-max | $D_G$-min | Green Contrast |
|---|---|---|---|---|
| F | N | 2.0 | ≅0.15 | 2.1 |

EXAMPLE 6

Emulsion T-6, a tabular grain AgBrI (97:3 molar ratio of Br to I) emulsion, had an average tabular grain diameter of 1.6 μm, an average tabular grain thickness of 0.10 μm, and an average aspect ratio of 16:1, and greater than 80% of the total projected area of the grains was provided by the tabular grains.

This emulsion was optimally chemically sensitized with 100 mg sodium thiocyanate/Ag mole, 9.0 mg sodium thiosulfate pentahydrate/Ag mole, and 3.0 mg potassium tetrachloroaurate/Ag mole and optimally spectrally sensitized to the green region with a green absorbing carbocyanine dye.

A control AgBrI (97:3) emulsion, designated as Control Emulsion C-6, of the type described in Illingsworth U.S. Pat. No. 3,320,069, had an average grain diameter of 0.81 μm, an average grain thickness of approximately 0.55 μm, and an average aspect ratio of 1.5:1.

Control Emulsion C-6 was optimally chemically sensitized with 1.2 mg sodium thiosulfate pentahydrate/Ag mole and 0.4 mg potassium tetrachloroaurate/Ag mole and optimally spectrally sensitized to the green region of the spectrum with the same green absorbing carbocyanine dye employed above.

A single color integral imaging receiver, IIR, of the following structure was prepared using the above-described Tabular Emulsion T-6, and Control Emulsion C-6. Coverages are in (g/m²).

7. Overcoat layer: Bis(vinylsulfonyl)methane (0.071), gelatin (0.54)
6. Silver halide layer: Green sensitized silver bromoiodide (3% I) tabular grain emulsion, Emulsion T-6, (0.81 Ag), PRDR-1 (0.67), IRA-2 (0.32), Inhibitor 3 (0.043), gelatin (1.6)
5. Gelatin layer (4.8)
4. Opaque layer: Carbon (1.9) gelatin 1.3)
3. Reflecting layer: Titanium dioxide (17), gelatin (2.6)
2. Mordant layer: Poly(4-vinylpyridine) (2.2), gelatin (2.2)
1. Metal containing layer: Nickel sulfate hexahydrate (0.58), gelatin (1.1)

Coated on clear polyester support in the order of numbering.

A single color control coating of the same structure was prepared, except layer 6 had green sensitized silver bromoiodide (3% I) Control Emulsion C-6 (0.81 Ag).

Pods of the following compounds were prepared.

| | |
|---|---|
| Potassium hydroxide | 55.0 g/l |
| Electron transfer agent (ETA): 4-Hydroxymethyl-4-methyl-1-p-tolyl-3-pyrazolidinone | 15.0 g/l |
| Potassium bromide | 4.0 g/l |
| Ethylenediaminetetraacetic acid | 7.8 g/l |
| Sodium sulfite | 2.0 g/l |
| Carboxymethylcellulose | 56.0 g/l |
| Carbon | 165.0 g/l |
| Anionic surfactant (Tamol SN ®)* | 2.0 g/l |
| Lead oxide | 0.4 g/l |

*The sodium salt of a condensate of formaldehyde and naphthalene sulfonic acid.

Cover sheets as described in Example 2 were prepared.

The monochrome IIR containing either Emulsion T-6 or C-6 was exposed in a sensitometer through a graduated density test object at 1/200 sec with neutral density filtration sufficient to produce a full-scale $D_{max}/D_{min}$ image after processing with a viscous processing composition in a pod. The pod contents were spread at room temperature (23°) between the IIR and cover sheet using a pair of 100μ gap juxtaposed rollers. After a period of not less than 24 hours, the receiver side of the IIR was read to Status A density and a computer integrated D log E reversal curve was obtained. Sensitometric parameters from this reversal curve are tabulated below in Table VI:

TABLE VI

| Emulsion | Contrast* | Relative+ Speed | $D_{min}$ | $D_{max}$ |
|---|---|---|---|---|
| (Example) T-6 | 3.2 | 100 | 0.22 | 1.8 |
| (Control) C-6 | 2.0 | 99 | 0.22 | 1.6 |

*The contrast is measured from 0.2 density above D-min to 0.2 below D-max.
+The relative speed is measured at Density = 0.5, 30 = 0.3 log E.

The data show that the example high aspect ratio tabular grain emulsion had significantly higher contrast compared to an equivalent speed three dimensional emulsion. $D_{min}$ values were the same; the experiment emulsion also had the additional benefit of slightly higher $D_{max}$. Toe and shoulders were equivalent. Higher contrast, at a given silver coverage, is a very desirable feature in "camera speed" direct image viewing products of this type.

EXAMPLE 7

Two series of single color integral imaging receiver (IIR) elements of the same structure as Example 6 (but with modifications of layer 6) were prepared using the tabular grain Emulsion T-6 and the Control Emulsion, C-6, optimally sensitized as described in Example 6.

Silver halide layer 6: Green sensitized silver bromoiodide (3% I) tabular grain emulsion, G, or green sensitized silver bromoiodide (3% I) control emulsion, C-6, dispersions of imaging reagents are tabulated below:

| Emulsion | Example Emulsion T-6 ($g/m^2$) | Control Emulsion C-6 ($g/m^2$) |
|---|---|---|
| Silver Coverage (see Table below) | 0.08–0.97 | 0.08–0.97 |
| PRDR-1 | 0.67 | 0.67 |
| IRA-2 | 0.11 | 0.15 |
| Inhibitor 3 | 0.086 | 0.17 |
| Gelatin | 1.6 | 1.6 |

Pods were prepared as Example 6, except containing 20.0 g/l of the ETA and 2.0 g/l of potassium bromide. The same cover sheets were used as for Example 2. The same procedure was used as for Example 6, except the exposure time was 1/150 second. The results are summarized in Table VII.

TABLE VII

| Coating Ag Coverage | Green Dye Density D-max | Green Dye Density D-min | Relative Threshold Speed* | Δ Speed** |
|---|---|---|---|---|
| Tabular Grain Emulsion T-6 | | | | |
| 0.97 $g/m^2$ | 1.55 | 0.16 | 198 | |
| 0.65 $g/m^2$ | 1.70 | 0.17 | 187 | |
| 0.32 $g/m^2$ | 1.87 | 0.18 | 163 | 48 |
| 0.16 $g/m^2$ | 1.93 | 0.24 | 139 | |
| Control Emulsion C-6 | | | | |
| 0.97 $g/m^2$ | 0.63 | 0.16 | — | |
| 0.65 $g/m^2$ | 1.63 | 0.16 | 180 | |
| 0.32 $g/m^2$ | 1.98 | 0.17 | 130 | 89 |
| 0.16 $g/m^2$ | 2.03 | 0.41 | 91 | |

*30 units = 0.3 log E, measured at approximately 0.3 density units below $D_{max}$
**Over range 0.16 to 0.65 $g/m^2$ Emulsion fog is evidenced by lowered transferred dye D-max. High D-min reflects an insufficient degree of oxidation of the IRA by developing silver halide to prevent the reduction of the PRDR by the IRA. At the 0.65 $g/m^2$ silver halide coverage, both emulsions had nearly equivalent threshold speed. At the 0.97 $g/m^2$, the control emulsion gave too much fog to have a meaningful speed value. As the levels of silver halide dropped through the range to 0.16 $g/m^2$, both emulsions gave good image discrimination, but the control emulsion dropped 89 units in speed while the tabular emulsion lost only 48 units.

In these two comparisons the levels of IRA and inhibitor (which is released imagewise in the unexposed area, thereby suppressing fog) are notably different. Substantially lower levels of IRA and Inhibitor are required for the tabular emulsion to provide comparable results at any level of silver halide coverage. Therefore, less of the photographic reagents are necessary. When the control emulsion was coated with the same lower levels of IRA-II and Inhibitor-III as the tabular emulsion, the three higher levels were completely fogged (D-max=0.17 to 0.22).

EXAMPLE 8

(A Comparative Example)

Using the same emulsions compared in Example 7, a series of incorporated coupler photographic elements differing in silver coverage were prepared and compared. Coatings of the following structure were prepared: Coverages are in ($g/m^2$) or [g/Ag mole].

2. Overcoat layer: Gelatin (0:51), bis(vinylsulfonyl)methane (0.047)
1. Imaging layer: Gelatin (2.6), magenta coupler dispersion consisting of 1-(2,4-dimethyl-6-chlorophenyl)-3-[α-(3-n-penta-decylphenoxy)-butyramido]-5-pyrazolone coupler (0.75) in a mixture of isomers of tritolyl phosphate coupler solvent, coupler:coupler solvent 2:1, green sensitized silver bromoiodide (3% I) emulsion (either Tabular Grain Emulsion T-6 or Control Emulsion C-6) at the silver lever specified below, potassium 2-(2-octadecyl)-5-hydroquinone sulfonate [3.5].

Coated on clear polyester support.

The monochrome coatings were exposed on a sensitometer at 1/100 second through a graduated density test object with neutral density filtration sufficient to produce a full-scale D-max/D-min image. The exposed strips were processed for three minutes development at 38±0.2° C. using a C-41 process described in the *British Journal of Photography Annual,* 1979. The Status M Transmission green density was read and a computer integrated D log E negative curve was obtained. Sensitometric parameters from these curve(s) are tabulated in Table VIII below:

TABLE VIII

| Silver Coverage (g $Ag/m^2$) | Green D-min | Log E Speed* | Δ Speed** |
|---|---|---|---|
| Tabular Emulsion T-6 | | | |
| 1.00 | 0.10 | 89 | |
| 0.69 | 0.10 | 74 | |
| 0.35 | 0.08 | 55 | 64 |
| 0.17 | 0.07 | 25 | |
| Control Emulsion C-6 | | | |
| 0.95 | 0.09 | 97 | |
| 0.64 | 0.10 | 77 | |
| 0.30 | 0.08 | 55 | 68 |
| 0.17 | 0.08 | 29 | |

*30 units = 0.3 log E. Speed measured at 0.1 density above fog. These are relative speeds and are not comparable in an absolute sense with those reported in Examples 6 and 7.
**Over range of the highest (1.00 or 0.95 $Ag/m^2$) to lowest (0.17 g $Ag/m^2$).

If the incorporated coupler photographic elements containing maximum and minimum silver coverages of each emulsion are compared, a speed difference with Emulsion T-6 of 0.64 log E versus a speed difference of 0.68 log E with Control Emulsion C-6 can be calculated from the data tabulated. The tabulation of results above shows the incorporated coupler photographic element containing Emulsion T-6 at a coverage at 0.17 g $Ag/m^2$ to have a photographic speed of 0.49 log E less than an otherwise identical incorporated coupler photographic element containing Emulsion T-6 at a silver coverage of 0.69 g $Ag/m^2$. Comparing the incorporated coupler photographic elements containing Control Emulsion C-6 at silver coverages of 0.17 g $Ag/m^2$ and 0.64 g $Ag/m^2$, a speed difference of 0.48 log E appears.

No significant differences in speed loss were observed in comparing the incorporated coupler photographic elements containing Emulsion T-6 and Control Emulsion C-6. The small differences in speed loss, 0.49 minus 0.48 (0.01) log E greater speed loss with Emulsion T-6 and 0.68 minus 0.64 (0.04) log E greater speed loss with Control Emulsion C-6, are not large enough to be meaningful. Rather, they appear to be within the level of ordinary experimental variances.

EXAMPLES 9 THROUGH 11

Using emulsions corresponding to the high aspect ratio tabular grain silver bromoiodide emulsion designated Emulsion T-6 in Example 7 and the control silver bromoiodide emulsion designated Emulsion C-6 in Example 7, three series of image transfer film units were prepared and compared, each series containing a different initially mobile dye image providing material. Each image transfer film unit consisted of a donor sheet, a receiver, and a developer composition. Only the donor sheets were varied. Within each series three pairs of donor sheets were prepared. Each pair of donor sheets differed in silver coverage, and the donor sheets in each pair differed in containing either Emulsion T-6 or Emulsion C-6. Coverages are in (g/m$^2$) or [g/Ag mole].

In the first series of image transfer film units, designated the Oxichromic Series, a cyan oxichromic developer of the structure I, shown below, was employed. In the second series of image transfer film units, designated the Indichromic Series, a magenta indichromic developer of the structure II, shown below, was employed. In the third series of image transfer film units, designated the Dye Developer Series, a magenta dye developer of the structure III, shown below, was employed.

Donor sheets of the Oxichromic Series were prepared as follows:

Overcoat Layer: Gelatin (0.86), bis(vinylsulfonyl)-methyl ether hardener (0.052)

Emulsion Layer: Gelatin (2.2), Inhibitor IV [4.7] and Reductant V [6.6] both dispersed in N,N-diethyllauramide (1:1 solid:solvent weight ratio), and Emulsion T-6 or C-6 at Ag coverages identified below.

Image Dye Layer: Gelatin (2.2), cyan oxichromic developer I (0.38) dispersed in N,N-diethyllauramide (1:1 solid:solvent weight ratio)

Coated on transparent polyester support.

Donor sheets of the Indichormic Series were prepared identically as those for the Oxichromic Series, except that the magenta indichromic developer II (0.38) was substituted for the cyan oxichromic developer I and the weight ratio of the magenta indichromic developer II to N,N-diethyllauramide was 1:2.

Donor sheets of the Dye Developer Series were prepared identically as those of the Oxichromic Series, except that the magenta dye developer III (0.22) was substituted for the cyan oxichromic developer I. The weight ratio of the magenta dye developer III to N,N-diethyllauramide remained as 1:1.

The structure of the compounds identified above by Roman numerals in these donor sheets was as follows:

Cyan Oxichromic Developer

-continued

I.

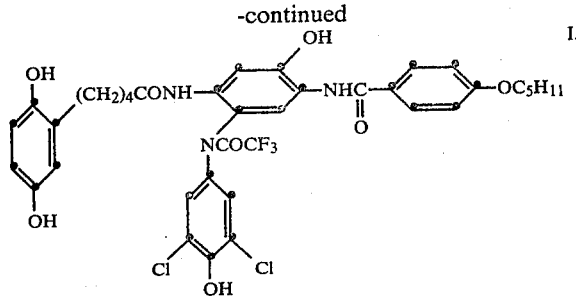

Magenta Indichromic Developer

II.

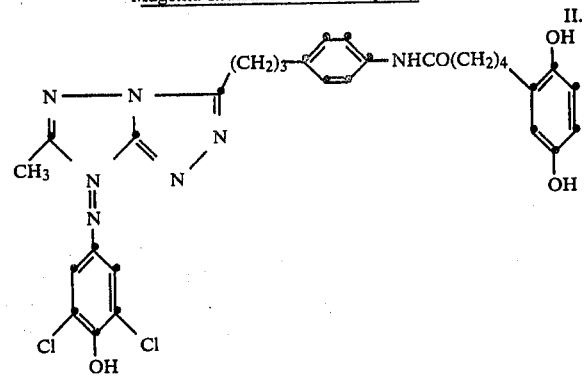

Magenta Dye Developer

III.

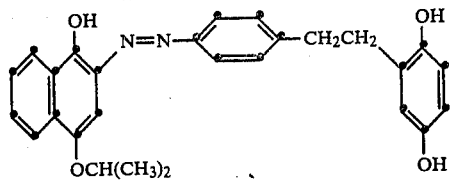

Inhibitor

IV.

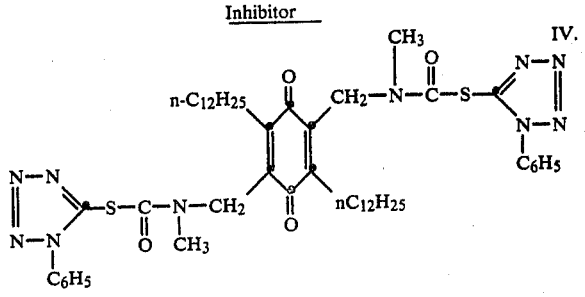

Reductant

V.

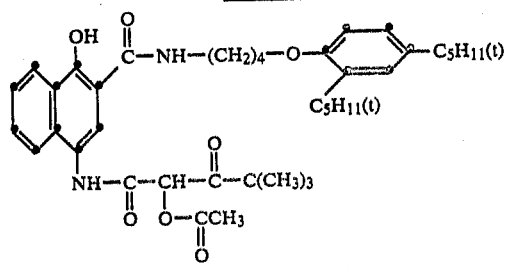

The receiver used for each image transfer film unit was Kodak Ektaflex PCT Paper®.

The viscous developer composition used for each image transfer film unit consisted of the following:

| | |
|---|---|
| Potassium hydroxide | 25 g/l |
| Potassium bromide | 10 g/l |

-continued

| | |
|---|---|
| 4-Hydroxymethyl-4-methyl-1-p-tolyl-3-pyrazolidinone | 3 g/l |
| Carboxymethylcellulose | 40 g/l |

The Oxichromic Series donor sheets were each identically exposed in an Eastman Ib Sensitometer at 1/50 second through the same graduated density test object having a sufficient range of neutral density filtration to produce an image after processing with a viscous developer. A measured portion of the developer was spread at room temperature (23° C.) between the donor sheet and the receiver using a pair of juxtaposed rollers to provide a developer layer thickness of 100 μm. After three minutes the receiver was peeled from the donor and washed in water for five minutes. The receiver was read to Status A density and a computer integrated D log E characteristic curve produced by transferred image dye, hereinafter referred to as a reversal curve, was obtained. Density values at maximum exposure (D-xmx) and at minimum exposure (D-xmn) were read from the reversal curves, and are tabulated below. D-xmx values correspond to test object densities of 0. The results are summarized below in Table IX.

TABLE IX

| Emulsion | Silver Coverage | Red Density D-xmn | Red Density D-xmx |
|---|---|---|---|
| T-6 | 0.32 g/m$^2$ | 1.8 | 0.09 |
| T-6 | 0.65 g/m$^2$ | 1.9 | 0.09 |
| T-6 | 0.97 g/m$^2$ | 1.6 | 0.09 |
| C-6 | 0.32 g/m$^2$ | 1.8 | 0.38 |
| C-6 | 0.65 g/m$^2$ | 1.7 | 0.34 |
| C-6 | 0.97 g/m$^2$ | 1.6 | 0.28 |

All D-xmxs of the image transfer film units using the tabular grain emulsion, Emulsion T-6, were low, well defined, and did not vary with silver coverage. D-xmxs were higher for the image transfer film units employing the control emulsion, Emulsion C-6, and, further, D-xmx increased as the silver coverage decreased.

Each Indichromic Series donor sheet was exposed and processed as described above with reference to the Oxichromic Series donor sheets, except the exposure was 1/25 sec and the donor sheet and receiver were peeled at one minute. D-xmn and D-xmx values from the reversal curves are tabulated below in Table X.

TABLE X

| Emulsion | Silver Coverage | Green Density D-xmn | Green Density D-xmx |
|---|---|---|---|
| T-6 | 0.32 g/m$^2$ | 1.6 | 0.18 |
| T-6 | 0.65 g/m$^2$ | 1.6 | 0.18 |
| T-6 | 0.97 g/m$^2$ | 1.9 | 0.18 |
| C-6 | 0.32 g/m$^2$ | 1.6 | 0.34 |
| C-6 | 0.65 g/m$^2$ | 1.7 | 0.42 |
| C-6 | 0.97 g/m$^2$ | 1.7 | 0.26 |

All D-xmxs of the image transfer film units using the tabular grain emulsion, Emulsion T-6, were low, well defined, and did not vary with silver coverage. D-xmx was higher for the image transfer film units employing the control emulsion, Emulsion C-6. D-xmx was higher at both 0.32 g/m$^2$ and 0.65 g/m$^2$ silver coverages than at 0.97 g/m$^2$ silver coverage.

Each Dye Developer Series donor sheet was exposed and processed as described in connection with the Oxichromic Series. D-xmn and D-xmx values from the reversal curves are tabulated below in Table XI.

TABLE XI

| Emulsion | Silver Coverage | Green Density D-xmn | Green Density D-xmx |
|---|---|---|---|
| T-6 | 0.32 g/m$^2$ | 1.5 | 0.15 |
| T-6 | 0.65 g/m$^2$ | 1.5 | 0.15 |
| T-6 | 0.97 g/m$^2$ | 1.4 | 0.14 |
| C-6 | 0.32 g/m$^2$ | 1.6 | 0.27 |
| C-6 | 0.65 g/m$^2$ | 1.5 | 0.18 |
| C-6 | 0.97 g/m$^2$ | 1.4 | 0.17 |

All D-xmxs of the image transfer film units using the tabular grain emulsion, Emulsion T-6, were low, well defined, and did not vary with silver coverage. D-xmx was higher for the image transfer film units employing the control emulsion, Emulsion C-6. While D-xmxs at silver coverages of 0.65 g/m$^2$ and 0.97 g/m$^2$ were not significantly different, both were lower than at the silver coverage of 0.32 g/m$^2$.

In considering collectively the results obtained using Oxichromic Series image transfer film units, Indichromic Series image transfer film units, and Dye Developer Series image transfer film units, I noted that in each instance the high aspect ratio tabular grain emulsion, Emulsion T-6, produced low, well defined D-xmxs that did not vary with silver coverage. However, in every instance the control emulsion, Emulsion C-6, produced higher D-xmxs at 0.32 g/m$^2$ silver coverage than at a silver coverage of 0.97 g/m$^2$.

Three examples, 12A, 12B and 13, which follow illustrate the improved access time and increased image discrimination which can be obtained using a negative working high aspect ratio tabular grain emulsion as compared to a conventional negative working low aspect ratio control emulsion in combination with an initially immobile negative working dye image providing material. More specifically, Tabular Grain Emulsion T-6 and Control Emulsion C-6 were used with negative working sulfonamidonaphthol redox dye releasers in a single-color image transfer integral film unit and were processed under the conditions (pH 13 to 14) characteristic of color image transfer processes.

Integral imaging receivers (IIRs) of the following structure were prepared (coverages expressed parenthetically are in g/m$^2$):

Layer 6: Gelatin (1.1), bis(vinylsulfonyl)methyl ether (0.095)

Layer 5: Gelatin (1.4), Tabular Grain Emulsion T-6 or Control Emulsion C-6, both green-sensitized silver bromoiodide emulsions (97 Br:3I), each at four levels of silver (0.16, 0.32, 0.65, 0.97 Ag), magenta redox dye releaser, RDR (0.38) of the following structure:

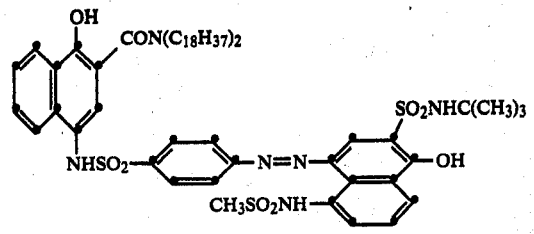

(Dispersed in N,N-diethyllauramide, solid:solvent 1:2)

Layer 4: Gelatin (0.54)

Layer 3: Gelatin (1.9), carbon (1.2)

Layer 2: Gelatin (3.0), titanium dioxide (19.)

Layer 1: Gelatin (2.2), poly(styrene-co-N-benzyl-N,N-dimethyl-N-vinylbenzylammonium chloride-co-divinylbenzene) (99:99:2 molar ratio) (2.3)

Coated on transparent polyester support.

Another set of coatings were prepared with the two emulsions, T-6 and C-6, each at the four levels of silver (0.16, 0.32, 0.65, 0.97 Ag) but containing in layer 5 a cyan RDR (0.27) of the following structure:

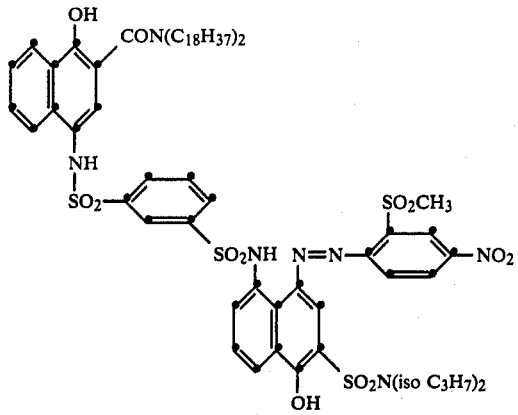

(Dispersed in N-n-butylacetanilide, solid:solvent 1:2)

Process control cover sheets consisting of an acid and timing layer as described in Wheeler U.S. Pat. No. 4,353,793 were prepared. One set, designated as CS-A, was as described by Wheeler, but contained 0.16 g/m$^2$ t-butylhydroquinone in the timing layer. Another set, designated CS-B, contained 1.8 g/m$^2$ total polymer in the timing layer without hydroquinone or inhibitor. Processing pods of the following composition were prepared:

| | |
|---|---|
| Potassium hydroxide | 46.8 g/l |
| 4-Methyl-4-hydroxymethyl-1-p-tolyl-3-pyrazolidinone | 4.0 g/l |
| 5-Methylbenzotriazole | 4.0 g/l |
| Carboxymethylcellulose | 43.0 g/l |

EXAMPLE 12A

A sample of each IIR containing 0.32 g/m$^2$ silver was uniformly exposed to white light (so as to insure obtaining maximum density on the transfers). The contents of the processing pod were spread at room temperature (23° C.) between the exposed IIR sample and the cover sheet, CS-B, using a pair of juxtaposed rollers to provide a fluid gap of 100 μm. The laminated unit was placed in a recording densitometer and the Status A red (for the cyan image dye sample) or green (for the magenta image dye sample) reflection density obtained at 10 second intervals up to 260 seconds (the time of lamination was taken as t=0). The results are summarized in Table XII.

TABLE XII

| Emulsion | | Status A Density at Given Time (sec) 30 | 60 | 90 | 260 |
|---|---|---|---|---|---|
| T-6 | G | 1.3 | 1.9 | 2.0 | 2.0 |
| C-6 | G | 0.5 | 0.7 | 0.8 | 0.9 |
| T-6 | R | 0.9 | 1.3 | 1.5 | 1.6 |
| C-6 | R | 0.3 | 0.6 | 0.7 | 0.7 |

The coatings containing either the magenta or cyan redox dye releaser with the high aspect ratio Tabular Grain Emulsion T-6 gave much higher densities at all times than the coating with the Control Emulsion, C-6. The density at 260 seconds, the highest density obtainable, is much lower for the coatings with the control emulsion. This is because development was terminated by the processing control cover sheet before silver development and dye release was complete. As the rate of silver development becomes slower (or the timing layer breakdown of the process control layer becomes shorter), development proceeds less to completion and the final maximum density decreases. The more efficient development of the tabular grain emulsion is thus demonstrated by both higher initial and final dye densities.

EXAMPLE 12B

The purpose of this example is to show that Tabular Grain Emulsion T-6 and Control Emulsion C-6 were capable of eventually producing essentially similar maximum transferred dye densities in the IIR samples when allowed to reach full development. The faster rate of dye density increase with the Tabular Grain Emulsion T-6 is also illustrated.

Except as noted, this Example was the same as Example 12A. The significant difference is that no process control cover shhet was used to terminate development. Lamination to an inert clear polyester cover sheet allowed development to go to completion (long term D-max/D-min discrimination does become less significant because the emulsion will go into fog). The same IIR samples, processing composition, and experimental procedure were used as Example 12A. Instead of a full-white light exposure, the IIR sample was uniformly exposed in an Eastman Ib Sensitometer for 1/25 second to white light. Results are summarized in Table XIII.

TABLE XIII

| Emulsion | | Status A Density at Given Time (sec) 30 | 60 | 90 | 260 |
|---|---|---|---|---|---|
| T-6 | G | 1.3 | 1.7 | 1.9 | 1.9 |
| C-6 | G | 0.9 | 1.5 | 1.8 | 1.9 |
| T-6 | R | 0.8 | 1.1 | 1.3 | 1.4 |
| C-6 | R | 0.6 | 0.9 | 1.0 | 1.3 |

Increased densities were obtained at short times after lamination with the coatings containing the high aspect ratio Tabular Grain Emulsion, T-6. At long times, the maximum densities are equivalent in this example because development was allowed to go to completion. These data may also be presented to show the time required to produce a given density, which even more directly illustrates the reduction in access time with the tabular grain emulsions of the invention. This comparison is shown in Table XIV.

TABLE XIV

| Emulsion | Time (sec) for D = 1.0 |
|---|---|
| T-6 | 21. |
| C-6 | 34. |
| T-6 | 42. |
| C-6 | 78. |

EXAMPLE 13

This example illustrates the greater image discrimination obtainable with image transfer units containing negative working tabular grain emulsions and initially immobile dye image providing materials.

Samples of the IIRs described above were processed with the same processing composition as Examples 12A and 12B, except the pod also contained 0.4 g/1 t-butylhydroquinone monoacetate. Process control cover sheet CS-A was used.

Each IIR sample as exposed for 1/50 second to a graduated density test object in an Eastman Ib Sensitometer with a Wratten 16 filter and sufficient neutral density to provide a full-scale transferred image. The contents of the processing pod were spread at room temperature (23° C.) between the exposed IIR and the cover sheet using a pair of juxtaposed rollers to provide a fluid gap of 100 μm. The receiver side of the laminated unit was read after a period of not less than three hours to Status A red (cyan dye samples) or green (magenta dye samples) reflection density. D-max and D-min values were read from computer integrated D log E curves. The results are summarized in Table XV.

TABLE XV

| | | | Status A Density | | Image Discrimination |
|---|---|---|---|---|---|
| $g/m^2$ Ag | Emulsion | | D-max | D-min | D-max D-min |
| 0.16 | T-6 | G | 1.8 | 0.19 | 1.6 |
| 0.16 | C-6 | G | 0.7 | 0.22 | 0.5 |
| 0.16 | T-6 | R | 2.0 | 0.14 | 1.9 |
| 0.16 | C-6 | R | 0.7 | 0.18 | 0.5 |
| 0.32 | T-6 | G | 2.0 | 0.19 | 1.8 |
| 0.32 | C-6 | G | 1.2 | 0.26 | 0.9 |
| 0.32 | T-6 | R | 2.0 | 0.14 | 1.9 |
| 0.32 | C-6 | R | 1.3 | 0.28 | 1.0 |
| 0.65 | T-6 | G | 2.0 | 0.20 | 1.8 |
| 0.65 | C-6 | G | 1.8 | 0.41 | 1.4 |
| 0.65 | T-6 | R | 1.9 | 0.15 | 1.8 |
| 0.65 | C-6 | R | 1.9 | 0.54 | 1.4 |
| 0.97 | T-6 | G | 2.0 | 0.23 | 1.8 |
| 0.97 | C-6 | G | 2.0 | 0.59 | 1.4 |
| 0.97 | T-6 | R | 2.0 | 0.16 | 1.8 |
| 0.97 | C-6 | R | 2.0 | 0.98 | 1.0 |

Independent of the level of silver the image transfer film units of the invention containing the Tabular Grain Emulsion, T-6, and either the magenta or cyan redox dye releaser gave increased image discrimination. The minimum densities (D-mins) obtained with the Tabular Grain Emulsion, T-6, were lower than those obtained with the Control Emulsion, C-6. The image transfer film units containing the Control Emulsion, C-6, produced higher minimum densities in the higher silver coverage samples.

APPENDIX

The following details relate to emulsion precipitation:

Emulsion T-1

To an aqueous bone gelatin, 0.17 molar potassium bromide solution (1.5% gelatin, Solution A) at pBr 0.77 and 55° C. were added by double-jet addition with stirring at a constant flow rate for 0.5 minutes (consuming 0.06% of total silver used), aqueous solutions of potassium bromide (1.51 molar, Solution B-1) and silver nitrate (1.0 molar, Solution C-1). (In all emulsion preparations the contents of the reaction vessel were vigorously stirred during silver salt addition.) Solutions B-1 and C-1 were halted; the emulsion was held for 5 minutes at pBr 0.77 and 55° C.

Solution C-1 was added next at a constant flow rate until pBr 1.14 at 55° C. was attained, consuming 3.49% of total silver used. Solution C-1 was halted.

Aqueous solutions of potassium bromide (4.52 molar, Solution B-2) and silver nitrate (2.0 molar, Solution C-2) were added next by double jet addition at an accelerated flow rate (6.5X from start to finish—i.e., 6.5 times faster at the end than at the start) at pBr 1.14 and 55° C. until Solution C-2 was exhausted (approximately 64 minutes; consuming 93.0% of the total silver used). Solution B-2 was halted.

An aqueous silver nitrate solution (2.0 molar, Solution C-3) was added next until pBr 1.51 at 55° C. was attained, consuming 3.42% of the total silver used. 6.45 Moles of silver were used to prepare this emulsion.

Finally, the emulsion was cooled to 35° C. and coagulation washed by the procedure of Yutzy and Russell U.S. Pat. No. 2,614,929.

Emulsion T-2

A 7.0 liter aqueous bone gelatin, 0.17 molar sodium bromide solution (17.1% gelatin, Solution A) at pH 2.0 and 70° C. was prepared. To Solution A, adjusted to pBr 0.77 at pH 2.0 and 70° C., were added by double-jet technique at constant flow rate for 4 minutes (0.67% of total silver consumed), aqueous solutions of sodium bromide (0.45 molar, Solution B-1) and silver nitrate (0.10 molar, Solution C-1). Solutions B-1 and C-1 were halted; the reaction vessel was held for 2 minutes at 70° C.

Solutions B-1 and C-1 were added next to Solution A, while maintaining pBr 0.77, at a constant flow rate while simultaneously adding at one-half the flow rate aqueous solutions of sodium bromide (3.78 molar, Solution B-2) and silver nitrate (2.72 molar, Solution C-2) to Solutions B-1 and C-1, respectively. When Solutions B-1 and B-2 were depleted (approximately 29 minutes; 81.8% of total silver consumed), the addition of Solution C-1 was continued until pBr 1.15 was attained. Solutions C-1 and C-2 were halted.

An aqueous solution of sodium iodide (0.13 molar, Solution D) was added next at constant flow rate for approximately 2.5 minutes. After holding Solution A for 2 minutes at 70° C. and pBr 1.02, Solutions C-1 and C-2 were continued until depleted (17.6% of total silver consumed). Total run time for Solution C was approximately 43 minutes. The final pBr in the reaction vessel was recorded at about 1.83. 6.0 Moles of silver were used to prepare this emulsion.

The emulsion was cooled to 40° C. and coagulation washed as described for Emulsion B.

Emulsion T-3

Prepared similarly as Emulsion C.

Emulsion T-4

A 2.0 liter aqueous poly(3-thiapentyl methyacrylate-co-acrylic acid-co-2-methacryloyloxyethyl-1-sulfonic acid, sodium salt) (1:2:7 molar ratio) solution (0.63% polymer, Solution A) containing calcium chloride dihydrate (0.50 molar), adenine (0.35%) and sodium bromide (0.013 molar) at pH 2.6 and 55° C. was prepared. To Solution A, maintained at the original chloride ion concentration throughout the entire procedure, were added by double-jet addition at constant flow rate for 1 minute (0.7% of total silver consumed), aqueous solutions of calcium chloride (2.0 molar, Solution B) and silver nitrate (2.0 molar, Solution C).

After the initial minute at constant flow rate, Solutions B and C were added by double-jet addition at an accelerated flow rate (2.3× from start to finish) for 15 minutes (18.8% of total silver consumed).

After the 15 minute accelerated flow rate period, Solutions B and C were added by double-jet at a constant flow rate for approximately 46 minutes (80.5% of total silver consumed).

An aqueous solution of sodium hydroxide (0.2 molar, Solution D) was used to maintain pH 2.6 at 55° C. 4.0 Moles of silver were used to precipitate this emulsion.

Emulsion T-5

To 6.0 liters of a 1.5% gelatin, 0.12 molar potassium bromide solution at 55° C. were added with stirring and by double-jet, a 2.0 molar KBr solution containing 0.12 molar KI and a 2.0 molar $AgNO_3$ solution over an eight minute period, while maintaining the pBr of 0.92 (consuming 5.3% of the total silver used). The bromide and silver solutions were then run concurrently maintaining pBr 0.92 in an accelerated flow (6.0X from start to finish) over 41 minutes (consuming 94.7% of the total silver used). A total of approximately 3.0 moles of silver was used. The emulsion was cooled to 35° C., washed by the coagulation method of Yutzy and Russell U.S. Pat. No. 2,614,929, and stored at pAg 7.6 measured at 40° C. The resultant tabular grain AgBrI (6 mole % iodide) emulsion had an average grain size of 3.0 μm, an average thickness of 0.09 μm, an aspect ratio of 33:1, and 85% of the grains were tabular based on projected area.

120 g of the AgBrI emulsion (0.12 mole) prepared above was adjusted to pAg 7.2 at 40° C. by the simultaneous addition of 0.1 molar $AgNO_3$ and 0.006 molar KI solutions. Then 3.0 ml of a 0.74 molar NaCl solution were added. The emulsion was spectrally sensitized with 1.5 millimole of anhydro-5-chloro-9-ethyl-5'-phenyl-3,3'-di-(3-sulfopropyl)oxacarbocyanine hydroxide, triethylamine salt/Ag mole and held for 30 minutes at 40° C. Then the spectrally sensitized emulsion was centrifuged and resuspended in a $1.85\times10^{-2}$ molar NaCl solution two times. To 40.0 g of the emulsion (0.04 mole) was precipitated 1.25 mole % AgCl by doublejet addition for 2.1 minutes of 0.55 molar NaCl and 0.5 molar $AgNO_3$ solutions while maintaining the pAg at 7.5 at 40° C. Fifteen seconds after the start of the AgCl precipitation 0.5 mg $Na_2S_2O_3.5H_2O$ and 0.5 mg $KAuCl_4$/Ag mole were added to the precipitation vessel.

In the preparation of each of the emulsions the contents of the reaction vessel was vigorously stirred during introduction of silver and halide salts.

The invention has been described in detail with particular reference to preferred embodiments thereof, but it will be understood that variations and modifications can be effected within the spirit and scope of the invention.

What is claimed is:

1. In a photographic image transfer film unit comprising a support, a negative working emulsion layer located on said support containing a dispersing medium and radiation sensitive silver halide grains, located in said emulsion layer or in a layer adjacent thereto a positive working dye image providing material capable of providing transferred image dye in the absence of silver halide development, and a receiving layer for providing a viewable transferred dye image following imagewise exposure and processing of said emulsion layer, the improvement wherein at least 50 percent of the total projected area of said radiation sensitive silver halide grains is provided by tabular silver halide grains having a thickness of less than 0.5 micron, a diameter of at least 0.6 micron, and an average aspect ratio of greater than 8:1.

2. A photographic image transfer film unit according to claim 1 in which said receiving layer is positioned adjacent a second support.

3. A photographic image transfer film unit according to claim 2 in which said second support is a reflective support.

4. A photographic image transfer film unit according to claim 2 in which said second support is transparent.

5. A photographic image transfer film unit according to claim 2 in which said film unit additionally includes an alkaline processing composition and means for releasing said composition between said supports.

6. A photographic image transfer film unit according to claim 1 in which said dye image providing material is a silver halide developing agent.

7. A photographic image transfer film unit according to claim 1 in which said tabular silver halide grains account for at least 70 percent of the total projected area of said radiation sensitive grains present in said emulsion layer.

8. A photographic image transfer film unit according to claim 1 in which the halide of said silver halide grains consists essentially of bromide optionally in combination with iodide.

9. A photographic image transfer film unit according to claim 1 in which said tabular silver halide grains have an average aspect ratio of at least 12:1.

10. In a dye image transfer film unit comprising a transparent support, a negative working emulsion layer located on said support containing a dispersing medium and chemically and spectrally sensitized radiation sensitive silver halide grains, a positive working dye image providing material capable of providing transferred image dye in the absence of silver halide development, located in said emulsion layer or in a layer adjacent thereto, a transparent cover sheet, a dye receiving layer located on said cover sheet to receive image dye transferred through an alkaline processing composition located between said receivof the total projected area of said radiation sensitive silver halide grains is provided by tabular silver halide grains having a thickness of less than 0.5 micron, a diameter of at least 0.6 micron, and an average aspect ratio of at least 12:1.

11. A dye image transfer film unit according to claim 10 additionally including means for initially confining and, following imagewise exposure, releasing the alkaline processing composition between said emulsion and receiving layers and means for terminating silver halide development positioned adjacent one of said support and said cover sheet.

12. A dye image transfer film unit according to claim 10 additionally including a reflective layer positioned adjacent said receiving layer and between said receiving layer and said one emulsion layer.

13. A dye image transfer film unit according to claim 10 in which said tabular silver halide grains have an average aspect ratio of at least 20:1.

14. A dye image transfer film unit according to claim 10 in which said one emulsion layer provides a silver coverage of less than 750 mg/m$^2$.

15. In a multicolor dye image transfer film unit comprising a support, dye providing layer units located on said support each comprised of at least one positive working dye image providing material capable of providing transferred image dye in the absence of silver halide development chosen from the class consisting of (a) initially immobile dye releasers capable of releasing a mobile dye moiety as an inverse function of silver halide development and (b) mobile slver halide developing agents which contain an image dye or dye forming moiety capable of being immobilized as a direct function of silver halide development and at least one negative working silver halide emulsion containing a dispersing medium and radiation sensitive silver halide grains, said dye providing layer units including a dye providing layer unit containing a red sensitive emulsion and a cyan dye image providing material, a dye providing layer unit containing a green sensitive emulsion and a magenta dye image providing material, and a dye providing layer unit containing a blue sensitive emulsion and a yellow dye image providing material, and a receiving layer for providing a viewable transferred multicolor dye image following imagewise exposure and processing, the improvement wherein at least 70 percent of the total projected area of said radiation sensitive silver halide grains in at least one of said emulsions is provided by tabular silver halide grains having a thickness of less than 0.5 micron, a diameter of at least 0.6 micron, and an average aspect ratio of at least 12:1.

16. A multicolor dye image transfer film unit according to claim 15 in which said tabular silver halide grains account for at least 90 percent of the total projected area of at least said one emulsion.

17. A multicolor dye image transfer film unit according to claim 15 in which said one emulsion is coated to provide a silver coverage in the range of from 150 to 750 mg/m$^2$.

18. A multicolor dye image transfer film unit according to claim 15 in which at least 70 percent of the total projected area of said radiation sensitive silver halide grains in each of said green and red sensitive emulsions is provided by tabular grains having a thickness of less than 0.3 micron, a diameter of at least 0.6 micron, and an average aspect ratio of at least 20:1.

19. A multicolor dye image transfer film unit according to claim 15 in which said emulsion containing said tabular grains is a red sensitive or green sensitive silver bromide emulsion optionally containing silver iodide and is positioned to receive exposing radiation prior to the remaining silver halide emulsions of said film unit.

20. In a multicolor dye image transfer film unit comprising a support, dye providing layer units located on said support each comprised of at least one positive working dye image providing material, comprised of an initially immobile redox dye releaser capable of releasing a mobile dye moiety upon reduction as an inverse function of silver halide development, and at least one negative working silver halide emulsion containing a dispersing medium and radiation sensitive silver halide grains, said dye providing layer units including a dye providing layer unit containing a red sensitive emulsion and a cyan dye image providing material, a dye providing layer unit containing a green sensitive emulsion and a magenta dye image providing material, and a dye providing layer unit containing a blue sensitive emulsion and a yellow dye image providing material, and a transparent cover sheet, a dye receiving layer located on said support or said cover sheet, an alkaline processing composition, means for releasing said processing composition into contact with said dye providing layer units, and means for terminating silver halide development positioned adjacent said support or said cover sheet, the improvement wherein at least 70 percent of the total projected area of said radiation sensitive silver halide grains present in at least one said emulsion is provided by tabular silver halide grains having a thickness of less than 0.5 micron, a diameter of at least 0.6 micron, and an average aspect ratio of at least 12:1, said silver halide grains in at least said one emulsion being coated at a silver coverage of from 150 to 750 mg/m$^2$.

21. In a multicolor dye image transfer film unit comprising a support, dye providing layer units located on said support each comprised of at least one initially immobile positive working redox dye releaser capable of releasing a mobile dye moiety upon reduction as an inverse function of silver halide development and at least one negative working emulsion containing a dispersing medium and radiation sensitive silver bromide or bromoiodide grains, said dye providing layer units including a dye providing layer unit containing a red sensitive emulsion and a cyan redox dye releaser material, a dye providing layer unit containing a green sensitive emulsion and a magenta redox dye releaser material, and a dye providing layer unit containing a blue sensitive emulsion and a yellow redox dye releaser material, and a transparent cover sheet, a dye receiving layer located on said support or said cover sheet, an alkaline processing composition, means for releasing said processing composition into contact with said dye providing layer units, and means for terminating silver halide development positioned adjacent said support or said cover sheet, the improvement wherein at least 70 percent of the total projected area of said radiation sensitive silver halide grains present in said emulsion is provided by tabular silver bromide or bromoiodide grains having a thickness of less than 0.3 micron, a diameter of at least 0.6 micron, and an average aspect ratio of at least 12:1, said grains of each of said emulsions being coated at a silver coverage of from 200 to 700 mg/m$^2$.

22. A multicolor dye image transfer film unit according to claim 21 in which each of said emulsions is coated at a silver coverage of from 300 to 650 mg/m$^2$.

23. In a multicolor dye image transfer film unit comprising a support, a yellow dye providing layer unit located on said support comprised of a positive working yellow dye image providing material capable of providing transferred yellow image dye in the absence of silver halide development and a blue sensitive negative working emulsion, a scavenger containing transparent first interlayer, a cyan dye providing layer unit located on said first interlayer comprised of a cyan dye image providing material capable of providing transferred cyan image dye in the absence of silver halide development and a red sensitive negative working emulsion, a scavenger containing transparent second interlayer, a magenta dye providing layer unit located on said second interlayer comprised of a magenta dye image providing material capable of providing transferred magenta image dye in the absence of silver halide development and a green sensitive negative working emulsion, each of said emulsions containing a dispersing medium and radiation sensitive silver bromide or bromoiodide grains, and a receiving layer for providing a viewable transferred multicolor dye image following imagewise exposure and processing of said emulsions, the improvement wherein at least 70 percent of the total projected area of said radiation sensitive grains present in at least said green and red sensitive emulsions is provided by tabular silver bromide or bromoiodide grains having a thickness of less than 0.3 micron, a diameter of at least 0.6 micron, and an average aspect ratio of at least 12:1, said grains of each of said green and red sensitive emulsions being coated at a silver coverage of from 200 to 700 mg/m$^2$, and said receiving layer being located nearer said cyan dye providing or said magenta dye providing layer unit than said remaining dye providing layer units during processing.

24. A multicolor image transfer film unit according to claim 23 in which said dye image providing materials are silver halide developing agents.

25. In a multicolor dye image transfer film unit comprising an opaque support, a yellow dye providing layer unit located on said support comprised of a positive working yellow redoc dye releaser material capable of releasing a mobile yellow dye moiety upon reduction as an inverse function of silver halide development and a blue sensitive negative working emulsion, a scavenger containing transparent first interlayer, a cyan dye providing layer unit located on said first interlayer comprised of a positive working cyan redox dye releaser material capable of releasing a mobile cyan dye moiety upon reduction as an inverse function of silver halide development and a red sensitive negative working emulsion, a scavenger containing transparent second interlayer, a magenta dye providing layer unit located on said second interlayer comprised of a positive working magenta redox dye releaser material capable of releasing a mobile magenta dye moiety upon reduction as an inverse function of silver halide development and a green sensitive negative working emulsion, each of said emulsions containing a dispersing medium and radiation sensitive silver bromide or bromoiodide grains, and a transparent cover sheet, a dye receiving layer located on said cover sheet, an alkaline processing composition containing reflective material and an indicator dye which is colored at an alkaline pH and substantially colorless at an acid pH, means for releasing said processing composition between said receiving layer and said dye providing layer units, and means for terminating silver halide development positioned adjacent said support or said cover sheet, at least 70 percent of the total projected area of said radiation sensitive grains present in said green and red sensitive emulsions being provided by tabular grains having a thickness of less than 0.3 micron, a diameter of at least 0.6 micron, and an average aspect ratio of at least 12:1, said grains of said green and red sensitive emulsions each being coated at a silver coverage of from 300 to 650 mg/m$^2$.

26. In a photographic image transfer film unit comprising a support, a negative working emulsion layer located on said support containing a dispersing medium and radiation sensitive silver halide grains, located in said emulsion layer or in a layer adjacent thereto an initially immobile negative working dye image providing material capable of providing transferred image dye in response to silver halide development, and a receiving layer for providing a viewable transferred dye image following imagewise exposure and processing of said emulsion layer, the improvement wherein at least 50 percent of the total projected area of said radiation sensitive silver halide grains is provided by tabular silver halide grains having a thickness of less than 0.5 micron, a diameter of at least 0.6 micron, and an average aspect ratio of greater than 8:1.

27. A photographic image transfer film unit according to claim 26 in which said receiving layer is positioned adjacent a second support.

28. A photographic image transfer film unit according to claim 26 in which said second support is a reflective support.

29. A photographic image transfer film unit according to claim 26 in which said second support is transparent.

30. A photographic image transfer film unit according to claim 26 in which said film unit additionally includes an alkaline processing composition and means for releasing said composition between said supports.

31. A photographic image transfer film unit according to claim 26 in which said tabular silfer halide grains account for at least 70 percent of the total projected area of said radiation sensitive grains present in said emulsion layer.

32. A photographic image transfer film unit according to claim 26 in which the halide of said silver halide grains consists essentially of bromide optionally in combination with iodide.

33. A photographic image transfer film unit according to claim 26 in which said tubular silver halide grains have an average aspect ratio of at least 12:1.

34. In a dye image transfer film unit comprising a transparent support, a negative working emulsion layer located on said support containing a dispersing medium and chemically and spectrally sensitized radiation sensitive silver halide grains, an initially immobile negative working dye image providing material capable of providing transferred image dye in response to silver halide development, located in said emulsion layer or in a layer adjacent thereto, a transparent cover sheet, a dye receiving layer located on said cover sheet to receive image dye transferred through an alkaline processing composition located between said receiving and emulsion layers, the improvement wherein at least 70 percent of the total projected area of said radiation sensitive silver halide grains is provided by tabular silver halide grains having a thickness of less than 0.5 micron, a diameter of at least 0.6 micron, and an average aspect ratio of at least 12:1.

35. A dye image transfer film unit according to claim 34 additionally including means for initially confining and, following imagewise exposure, releasing the alkaline processing composition between said emulsion and receiving layers and means for terminating silver halide development positioned adjacent one of said support and said cover sheet.

36. A dye image transfer film unit according to claim 34 additionally including a reflective layer positioned adjacent said receiving layer and between said receiving layer and said one emulsion layer.

37. A dye image transfer film unit according to claim 34 in which said tubular silver halide grains have an average aspect ratio of at least 20:1.

38. In a multicolor dye image transfer film unit comprising a support, dye providing layer units located on said support each comprised of at least one initially immobile dye releaser capable of releasing a mobile dye moiety as a direct function of silver halide development and at least one negative working silver halide emulsion containing a dispersing medium and radiation sensitive silver halide grains, said dye providing layer units including a dye providing layer unit containing a red sensitive emulsion and a cyan dye image providing material, a dye providing layer unit containing a green sensitive emulsion and a magenta dye image providing material, and a dye providing layer unit containing a blue sensitive emulsion and a yellow dye image providing material, and a receiving layer for providing a viewable transferred multicolor dye image following imagewise exposure and processing, the improvement wherein at least 70 percent of the total projected area of said radiation sensitive silver halide grains in at least one of said emulsions is provided by tabular silver halide grains having a thickness of less than 0.5 micron, a diameter of at least 0.6 micron, and an average aspect ratio of at least 12:1.

39. A multicolor dye image transfer film unit according to claim 15 in which said tabular silver halide grains account for at least 90 percent of the total projected area of at least said one emulsion.

40. A multicolor dye image transfer film unit according to claim 38 in which at least 70 percent of the total projected area of said radiation sensitive silver halide grains in each of said green and red sensitive emulsions is provided by tabular grains having a thickness of less than 0.3 micron, a diameter of at least 0.6 micron, and an average aspect ratio of at least 20:1.

41. A multicolor dye image transfer film unit according to claim 38 in which said emulsion containing said tabular grains is a red sensitive or green sensitive silver bromide emulsion optionally containing silver iodide and is positioned to receive exposing radiation prior to the remaining silver halide emulsions of said film unit.

42. In a multicolor dye image transfer film unit comprising an opaque support, a yellow dye providing layer unit located on said support comprised of an initially immobile negative working yellow redox dye releaser material capable of releasing a mobile yellow dye moiety upon oxidation as a direct function of silver halide development and a blue sensitive negative working emulsion, a scavenger containing transparent first interlayer, a cyan dye providing layer unit located on said first interlayer comprised of an initially immobile negative working cyan redox dye releaser material capable of releasing a mobile cyan dye moiety upon oxidation as a direct function of silver halide development and a red sensitive negative working emulsion, a scavenger containing transparent second interlayer, a megenta dye providing layer unit located on said second interlayer comprised of an initially immobile negative working magenta redox dye releaser material capable of releasing a mobile magenta dye moiety upon oxidation as a direct function of silver halide development and a green sensitive negative working emulsion, each of said emulsions containing a dispersing medium and radiation sensitive silver bromide or bromoiodide grains, and a transparent cover sheet, a dye receiving layer located on said cover sheet, an alkaline processing composition containing reflective material and an indicator dye which is colored at an alkaline pH and substantially colorless at an acid pH, means for releasing said processing composition between said receiving layer and said dye providing layer units, and means for terminating silver halide development positioned adjacent said support or said cover sheet, at least 70 percent of the total projected area of said radiation sensitive grains present in said green and red sensitive emulsions being provided by tabular grains having a thickness of less than 0.3 micron, a diameter of at least 0.6 micron, and an average aspect ratio of at least 12:1.

* * * * *